US006991514B1

(12) United States Patent
Meloni et al.

(10) Patent No.: US 6,991,514 B1
(45) Date of Patent: Jan. 31, 2006

(54) OPTICAL CLOSED-LOOP CONTROL SYSTEM FOR A CMP APPARATUS AND METHOD OF MANUFACTURE THEREOF

(75) Inventors: Mark A. Meloni, Flower Mound, TX (US); Andrew W. Kueny, Dallas, TX (US)

(73) Assignee: Verity instruments, Inc., Carrollton, TX (US)

( * ) Notice: Subject to any disclaimer, the term of this patent is extended or adjusted under 35 U.S.C. 154(b) by 393 days.

(21) Appl. No.: 10/371,068

(22) Filed: Feb. 21, 2003

(51) Int. Cl.
*B24B 49/00* (2006.01)
*B24B 51/00* (2006.01)

(52) U.S. Cl. ..... 451/5; 451/6; 451/8; 451/36; 451/41; 451/288

(58) Field of Classification Search ..... 451/5, 451/6, 8, 9, 10, 36, 41, 59, 63, 285, 286, 451/287, 288
See application file for complete search history.

(56) References Cited

U.S. PATENT DOCUMENTS

| | | | | |
|---|---|---|---|---|
| 5,329,732 | A | 7/1994 | Karlsrud et al. | |
| 5,483,568 | A | 1/1996 | Yano et al. | |
| 5,658,183 | A | 8/1997 | Sandhu et al. | |
| 5,663,797 | A | 9/1997 | Sandhu | |
| 5,672,091 | A | 9/1997 | Takahashi et al. | |
| 5,700,180 | A | 12/1997 | Sandhu et al. | |
| 5,777,739 | A | 7/1998 | Sandhu et al. | |
| 5,851,135 | A | 12/1998 | Sandhu et al. | |
| 5,899,792 | A | 5/1999 | Yagi | |
| 5,910,846 | A | 6/1999 | Sandhu | |
| 5,936,733 | A | 8/1999 | Sandhu et al. | |
| 5,949,927 | A | 9/1999 | Tang | |
| 6,024,628 | A | 2/2000 | Chen | |
| 6,028,669 | A | 2/2000 | Tseng | |
| 6,045,439 | A | 4/2000 | Birang et al. | |
| 6,074,517 | A | 6/2000 | Taravade | |
| 6,075,606 | A | 6/2000 | Doan | |
| 6,106,662 | A | 8/2000 | Bibby, Jr. et al. | |
| 6,111,634 | A | 8/2000 | Pecen et al. | |
| 6,120,347 | A | 9/2000 | Sandhu et al. | |
| 6,146,242 | A | 11/2000 | Treur et al. | |
| 6,146,248 | A | 11/2000 | Jairath et al. | |
| 6,159,073 | A | 12/2000 | Wiswesser et al. | |
| 6,171,181 | B1 | 1/2001 | Roberts et al. | |
| 6,172,756 | B1 | 1/2001 | Chalmers et al. | |
| 6,204,922 | B1 | 3/2001 | Chalmers | |
| 6,621,584 | B2 * | 9/2003 | Pecen et al. | 356/630 |
| 6,707,540 | B1 * | 3/2004 | Lehman et al. | 356/72 |
| 6,746,319 | B2 * | 6/2004 | Tada et al. | 451/285 |

FOREIGN PATENT DOCUMENTS

WO WO 01/94074 A1 12/2001

OTHER PUBLICATIONS

Press et al.; Numerical Recipes in C: The Art of Scientific Computing; Cambridge University Press; Second Edition; 1992; pp. 504–510, 549–558, 591–606; 650–655.

Azzam et al.; Ellipsometry And Polarized Light; Elsevier Science B.V.; 1987; pp. 332–341.

* cited by examiner

*Primary Examiner*—Timothy V. Eley

(57) ABSTRACT

For use with a chemical mechanical polishing apparatus for polishing a semiconductor wafer having a platen, a polishing pad and a wafer carrier, an optical closed-loop control system. In one embodiment, the system includes a plurality of optical probes impacting a corresponding probe window and rigidly mountable through the platen. The system also includes a flash lamp configured to provide light to each of the plurality of optical probes and minimize an exposure time of the light onto the semiconductor wafer, a spectrograph configured to spatially image light received by each of the plurality of optical probes to a common charge-coupled device and produce real-time spectral reflectometry data therefrom. The system further includes a control subsystem configured to analyze the real-time spectral reflectometry data and determine at least one wafer state parameter therefrom, and cause the polishing to be adjusted based upon the at least one wafer state parameter.

42 Claims, 29 Drawing Sheets

OPTICAL CLOSED-LOOP CONTROL SYSTEM FOR A CMP APPARATUS AND METHOD OF MANUFACTURE THEREOF

TECHNICAL FIELD OF THE INVENTION

The present invention is directed, in general, to a semiconductor wafer polishing apparatus and, more specifically, to an optical closed-loop control system for use with a chemical mechanical polishing apparatus for polishing a semiconductor wafer.

BACKGROUND OF THE INVENTION

The manufacture of an integrated circuit device requires the formation of various materials onto a base substrate to form necessary circuit structures. During the manufacturing process, chemical-mechanical polishing (CMP) is employed to remove certain layers or reduce a layer to a precise thickness. More specifically, CMP employs the combination of chemical etching and mechanical abrasion to remove excess material. In the case of dielectric films, CMP is typically employed to planarize the surface. For metal films, such as copper, CMP is typically used to remove excess material so as to permit the delineation of electrically isolated circuit interconnects. Also, it might be assumed that semiconductor manufacturing processes produce precisely uniform layers of conductive, semiconductive and non-conductive materials. As with any physical process, however, there are imperfections in the processes that can contribute to non-planarity of the wafer.

FIG. 1 illustrates a portion of a typical CMP tool 100. The CMP tool 100 includes a platen 110 coupled to a spindle 120. The platen 110 may be capable of movement relative to a wafer carrier 160 and a wafer 170. The platen may rotate about the spindle 120 or other axes, translate in a plane, or orbit about an axis. Multiple variations of these types of movements are well known in the prior art. Coupled to the top of the platen 110 is a polishing pad 130. Within the polishing pad 130 are probe windows 132, 134 for probes 140, 142. The wafer 170 is held in the wafer carrier 160 by a wafer ring 162.

During the CMP process, a slurry 150 is applied to the top of the polishing pad 130 and the wafer 170 in the wafer carrier 160 is simultaneously moved (translated, rotated and/or orbited) relative to the platen 110 and pressed against the polishing pad 130 and the slurry 150. The action of the pressure and relative motion of the wafer carrier 160 and/or the platen 110 causes the removal and planarization of the material (also called film layers) that cover the wafer 170. The CMP process, however, may remove material faster from one portion of the wafer versus another portion of the wafer. For example, the CMP process may remove more material from the annular portion of the edge of the wafer than from the center of the wafer. This inconsistency is based upon the slurry 150, temperature, the material on the wafer, the amount of pressure, the movement of the wafer carrier 160 and the platen 110, and other factors.

To help control the inconsistencies of the CMP process, it is desirable to monitor the characteristics of the film layers so that the removal process is controlled and stopped appropriately. Excessive or improper polishing may often result in severely damaged circuit structures on the wafer 170. Some systems employ optical monitoring methods to help prevent excessive or improper polishing. These optical monitoring methods determine a thickness of the film layer by analyzing the optical reflectance spectrum from the film layer.

However, in order for such an analysis to be practical, three criteria should be met: (1) the reflection spectrum should be obtained in situ from a wafer in a timely manner without interfering with the CMP process, (2) the quality of the reflection spectrum should be sufficiently good such that the analysis can yield reliable, accurate and relevant information, and (3) practical algorithms should exist with which to do the analysis. Previous optical monitoring systems have failed to meet at least one of the criteria listed above.

Accordingly, what is needed in the art is a system that overcomes the deficiencies of the prior art.

To address the above-discussed deficiencies of the prior art, the present invention provides, for use with a chemical mechanical polishing (CMP) apparatus for polishing a semiconductor wafer, the CMP apparatus having a platen, a polishing pad coupleable with a top surface of the platen and a wafer carrier, an optical closed-loop control system, a method of manufacture and a method of operation thereof. In one embodiment, the optical closed-loop control system includes a plurality of optical probes impacting a corresponding probe window and rigidly mountable through the platen. The probe window is positioned within the polishing pad. The optical closed-loop control system also includes a flash lamp configured to provide light to each of the plurality of optical probes and minimize an exposure time of the light onto the semiconductor wafer, and a spectrograph configured to spatially image light received by each of the plurality of optical probes to a common charge-coupled device (CCD) and produce real-time spectral reflectometry data therefrom. The optical closed-loop control system further includes a control subsystem configured to analyze the real-time spectral reflectometry data and determine at least one wafer state parameter therefrom, and cause the polishing to be adjusted based upon the at least one wafer state parameter. For purposes of the present invention, the phrase "configured to" means that the device, the system or the subsystem includes the necessary software, hardware, firmware or a combination thereof to accomplish the stated task.

In another embodiment, the present invention provides a method of manufacturing an optical closed-loop control system for use with a chemical mechanical polishing (CMP) apparatus for polishing a semiconductor wafer, the CMP apparatus having a platen, a polishing pad coupleable with a top surface of the platen and a wafer carrier, the method includes rigidly mounting through the platen a plurality of optical probes impacting a corresponding probe window, the probe window positioned within the polishing pad. The method also includes coupling a flash lamp to each of the plurality of optical probes to provide light thereto and configuring the flash lamp to minimize an exposure time of the light onto the semiconductor wafer. The method further includes configuring a spectrograph to spatially image light received by each of the plurality of optical probes to a common charge-coupled device (CCD) and producing real-time spectral reflectometry data therefrom. The method still further includes configuring a control subsystem to analyze the real-time spectral reflectometry data and determine at least one wafer state parameter therefrom, and cause the polishing to be adjusted based upon the at least one wafer state parameter.

The present invention also provides, in one embodiment, a method of operating an optical closed-loop control system for use with a chemical mechanical polishing (CMP) apparatus for polishing a semiconductor wafer, the CMP apparatus having a platen, a polishing pad coupleable with a top surface of the platen and a wafer carrier, the method including: (1) employing a plurality of optical probes impacting a corresponding probe window and rigidly mountable through the platen, the probe window positioned within the polishing pad, (2) providing light to each of the plurality of optical probes employing a flash lamp and minimizing an exposure time of the light onto the semiconductor wafer, (3) spatially imaging light received by each of the plurality of optical probes to a common charge-coupled device (CCD) of a spectrograph and producing real-time spectral reflectometry data therefrom, and (4) analyzing the real-time spectral reflectometry data, determining at least one wafer state parameter from the real-time spectral reflectometry data, and causing the polishing to be adjusted based upon the at least one wafer state parameter.

In another embodiment, the present invention also provides an optical closed-loop control system for use with a chemical mechanical polishing (CMP) apparatus for polishing a semiconductor wafer, the CMP apparatus having a platen, a polishing pad coupleable with a top surface of the platen, a plurality of probe windows within the polishing pad and a wafer carrier. The optical closed-loop control system includes: (1) a plurality of optical probes coupleable to corresponding ones of the plurality of probe windows and mountable through the platen, (2) a flash lamp configured to provide light to each of the plurality of optical probes, (3) a spectrograph configured to spatially image light received by each of the plurality of optical probes and produce real-time spectral reflectometry data therefrom, and (4) a control subsystem configured to employ a n-band analysis to analyze the real-time spectral reflectometry data and determine at least one wafer state parameter therefrom, and cause the polishing to be adjusted based upon the at least one wafer state parameter.

In yet another embodiment, the present invention provides an optical closed-loop control system for use with a chemical mechanical polishing (CMP) apparatus for polishing a semiconductor wafer, the CMP apparatus having a platen, a polishing pad coupleable with a top surface of the platen, a plurality of probe windows within the polishing pad and a wafer carrier. The optical closed-loop control system includes: (1) a plurality of optical probes coupleable to corresponding ones of the plurality of probe windows and mountable through the platen, (2) a flash lamp configured to provide light to each of the plurality of optical probes, (3) a spectrograph configured to spatially image light received by each of the plurality of optical probes and produce real-time spectral reflectometry data therefrom, and (4) a control subsystem configured to employ a transform analysis to analyze the real-time spectral reflectometry data and determine at least one wafer state parameter therefrom, and cause the polishing to be adjusted based upon the at least one wafer state parameter.

The present invention may also provide an optical closed-loop control system for use with a chemical mechanical polishing (CMP) apparatus for polishing a semiconductor wafer, the CMP apparatus having a platen, a polishing pad coupleable with a top surface of the platen, a plurality of probe windows within the polishing pad and a wafer carrier, where the optical closed-loop control system includes: (1) a plurality of optical probes coupleable to corresponding ones of the plurality of probe windows and mountable through the platen, (2) a flash lamp configured to provide light to each of the plurality of optical probes, (3) a spectrograph configured to spatially image light received by each of the plurality of optical probes and produce real-time spectral reflectometry data therefrom, and (4) a control subsystem configured to employ a metal breakthrough analysis to analyze the real-time spectral reflectometry data and determine at least one wafer state parameter therefrom, and cause the polishing to be adjusted based upon the at least one wafer state parameter.

The present invention, in another embodiment, may provide an optical closed-loop control system for use with a chemical mechanical polishing (CMP) apparatus for polishing a semiconductor wafer, the CMP apparatus having a platen, a polishing pad coupleable with a top surface of the platen, a plurality of probe windows within the polishing pad and a wafer carrier, where the optical closed-loop control system includes: (1) a plurality of optical probes coupleable to corresponding ones of the plurality of probe windows and mountable through the platen, (2) a flash lamp configured to provide light to each of the plurality of optical probes, (3) a spectrograph configured to spatially image light received by each of the plurality of optical probes and produce real-time spectral reflectometry data therefrom, and (4) a control subsystem configured to employ a model analysis to analyze the real-time spectral reflectometry data and determine at least one wafer state parameter therefrom, and cause the polishing to be adjusted based upon the at least one wafer state parameter.

The foregoing has outlined preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
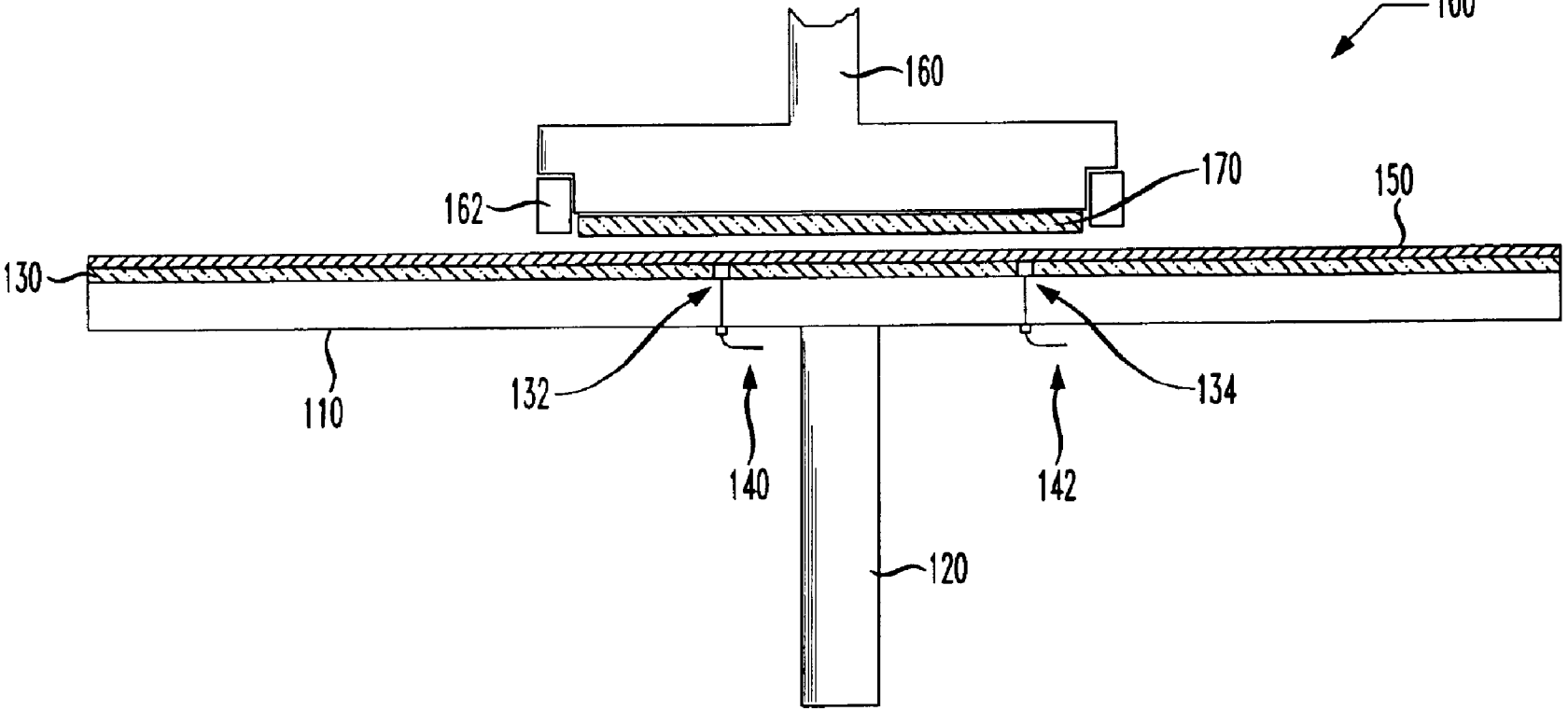
FIG. 1 illustrates a portion of a typical CMP tool.
Figure 2:
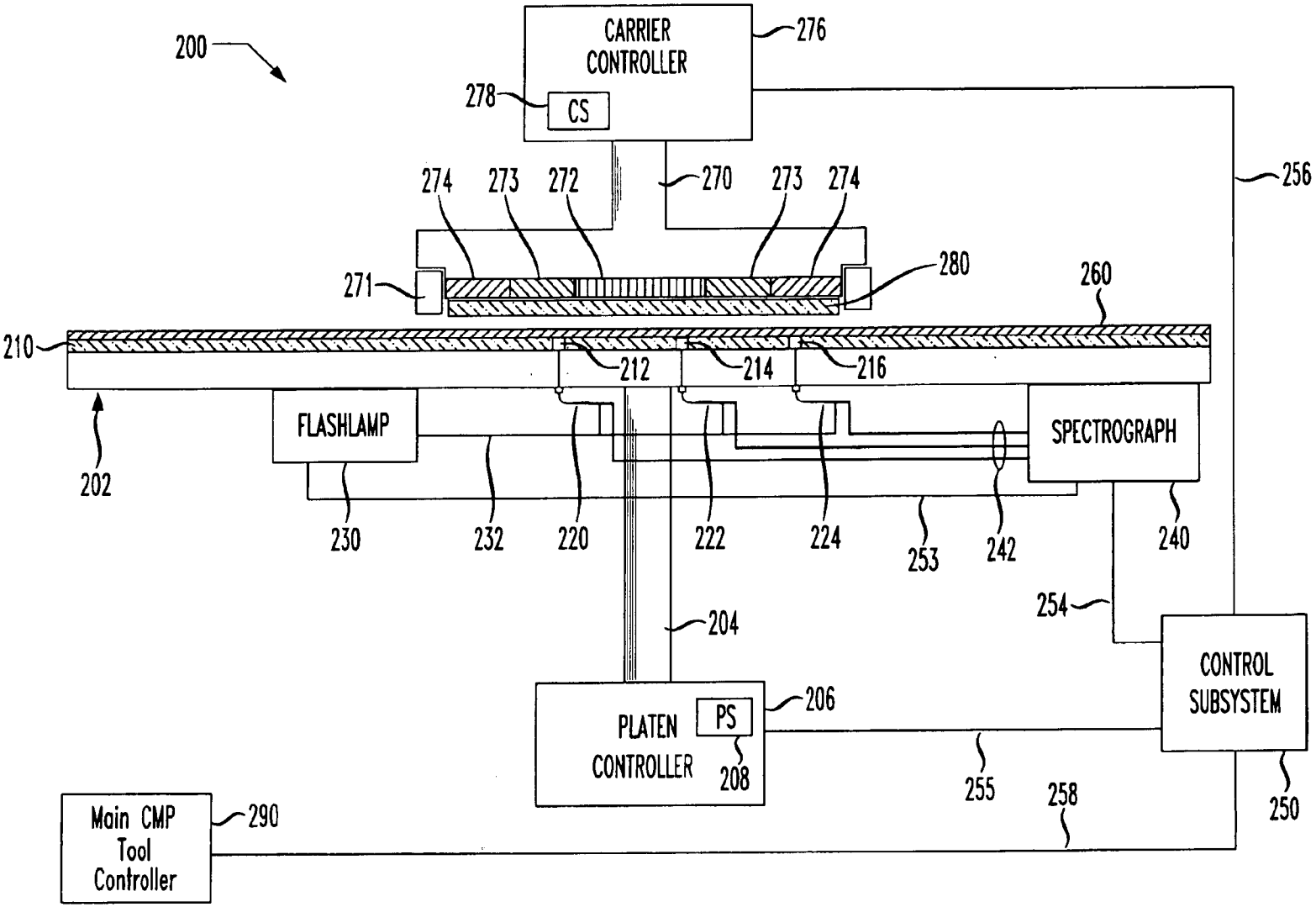
FIG. 2 illustrates an optical closed-loop control system for use with a chemical mechanical polishing apparatus constructed in accordance with the principles of the present invention.

Referring initially to FIG. 2, illustrated is an optical closed-loop control system, generally designated 200, for use with a chemical mechanical polishing (CMP) apparatus constructed in accordance with the principles of the present invention. Although the current embodiment is illustrated using a conventional rotary-type platen type CMP polisher, the invention may be used with other types of CMP polishers that are well known in the art, such as orbital and fixed platen systems. In one embodiment, the CMP apparatus includes a platen 202 and coupled to a top surface of the platen 202 is a conventional polishing pad 210. The platen 202 is also coupled to a spindle 204. The spindle 204 may be coupled to a platen controller 206 that is configured to cause translations, rotations, orbits or other compound movements of the platen 202 and spindle 204. The platen controller 206 also includes at least one platen sensor 208 that is configured to monitor the location of the platen 202 and the rotation speed of the spindle 204. For purposes of the present invention, the phrase "configured to" means that the device, the system or the subsystem includes the necessary software, hardware, firmware or a combination, thereof to accomplish the stated task, of course, however, the present invention is not limited to a moving platen. In other embodiments, the platen may be a fixed platen or a rotating platen.

The portion of the CMP apparatus illustrated also includes a wafer carrier 270. The wafer carrier 270 includes a ring 271 that holds a semiconductor wafer 260 in the wafer carrier 270. In the illustrated embodiment, the wafer carrier 270 includes three controllable pressure zones 272, 273, 274 that can be individually controlled to adjust the pressure applied to different portions of the semiconductor wafer 280 during the CMP process. The wafer carrier 270 may also be coupled to a carrier controller 276 that is configured to cause translations and/or rotations of the wafer carrier 270. The carrier controller 276 also includes at least one carrier sensor 278 that is configured to monitor the location and rotation speed of the wafer carrier 270. The carrier controller 276 is also configured to adjust or cause to be adjusted the pressure applied at each of the controllable pressure zones 272, 273, 274. Of course, however, the present invention is not limited to a single wafer carrier. Nor is the present invention limited to a wafer carrier having three controllable pressure zones. In other embodiments, the present invention may be configured to operate with a CMP apparatus having multiple wafer carriers and/or wafer carriers having any number of controllable pressure zones or no controllable pressure zones.

In the illustrated embodiment, the optical closed-loop control system 200 includes a plurality of optical probes 220, 222, 224 impacting a corresponding probe window 212, 214, 216. The probe windows 212, 214, 216 are positioned within the polishing pad 210. In a related embodiment, the optical probes may be positioned along the top surface of the platen 202 in such a manner to allow the monitoring of the semiconductor wafer 280 at specific radial locations. The impaction of the optical probes 220, 222, 224 with the probe windows 212, 214, 216 allows the optical probes 220, 222, 224 to maintain contact with their corresponding probe window 212, 214, 216 as the pressure applied to the semiconductor wafer 280 and to the polishing pad 210 changes. This impaction also substantially eliminates a water or air gap between the tip of the optical probe and the probe window, and, as such, decreases degradation of the optical signal. The optical probes 220, 222, 224 are also rigidly mountable through the platen 202 to help maintain a position of each of the optical probes 220, 222, 224. If the optical probes 220, 222, 224 are not positioned to impact the probe windows 212, 214, 216 and the optical probes 220, 222, 224 are not rigidly restrained, temporal variations of the optical path may occur. These temporal variations would then cause degradation of the optical signal analysis, which may result in inaccuracies of the CMP of the semiconductor wafer 280. See FIGS. 5A and 5B for a discussion of placement of a tip of an optical probe for impaction into the probe window employed.

The optical closed-loop control system 200 also includes a flash lamp 230 and a spectrograph 240. The flash lamp 230 is configured to provide light to each of the optical probes 220, 222, 224 via an optical illumination fiber cable 232. See FIGS. 4A and 4B for discussion of an optical probe and its connections. The flash lamp 230 is also configured to minimize an exposure time of the light onto the semiconductor wafer 280. In another embodiment, the flash lamp 230 in combination with each of the plurality of optical probes 220, 222, 224 provide sampling spot isolation, thereby preserving the interference contrast of the reflected light. See FIGS. 9A–C for more discussion on interference contrast of the reflected light.

The spectrograph 240 is configured to be coupled to each of the optical probes 220, 222, 224 via individual optical collection fiber cables 242. The spectrograph 240 is further configured to spatially image the light received by each of the optical probes 220, 222, 224. In another embodiment, the spectrograph 240 is further configured to spatially image the light received by each of the optical probes 220, 222, 224 to a common charge-coupled device (CCD). In yet another embodiment, the light received from each of the optical probes 220, 222, 224 are collimated reflections from the semiconductor wafer 280. The spectrograph 240 is also configured to produce real-time spectral reflectometry data from the spatially imaged light. The flash lamp 230 and the spectrograph 240, however, are not limited to only the three optical probes illustrated in FIG. 2. In other embodiments of the present invention, the flash lamp 230 may be configured to provide light to any number of optical probes and the spectrograph 240 may be configured to receive and spatially image light received from any number of optical probes. The flash lamp 230 may also be controlled by the spectrograph 240 via a control line 253. The spectrograph 240 may control the triggering time of the flash lamp strobe as well as any other operational parameters of the flash lamp 230. The spectrograph 240 may also directly monitor the light emitted by the flash lamp 230 using an additional fiber optic cable (not shown). See FIG. 26 for a more detailed discussion of an embodiment of the spectrograph 240.

In the illustrated embodiment, the optical closed-loop control system 200 also includes a control subsystem 250 that is configured to analyze the real-time spectral reflectometry data produced by the spectrograph 240 via a spectrograph/control data line 254 and determine at least one wafer state parameter therefrom. In a one embodiment, the control subsystem 250 is located within the CMP tool itself. In another embodiment, the control subsystem 250 may be individually mounted to the platen 202. (See FIG. 3). In yet another embodiment, the control subsystem 250 may be embodied within the spectrograph 240. In a related embodiment, the control subsystem 250 may be embodied within a conventional computer system employing specialized software, hardware or a combination thereof. For purposes of the present invention, the term "wafer state parameter" includes a reflection spectrum or any part thereof, an average of all or parts of one or more reflection spectra, a metrology data point or trends of data points derived from all or part of a reflection spectrum, a material layer removal rate, an error data point, an endpoint, a material layer thickness and a material layer change in thickness. Of course, however, a wafer state parameter may include other measurable or analytically derived data points not listed above. In another embodiment, the spectrograph data line 254 may be a high speed serial connection or part of a network. In yet another embodiment, the spectrograph 240 may communicate with the control subsystem 250 via wireless communications.

In the described embodiment, the platen controller 206, the carrier controller 276, the control subsystem 250 and the main tool controller 290 may be embodied within separate physical devices or computational systems, and may operate in a distributed control scheme. In a related embodiment, the platen controller 206, the carrier controller 276, the control subsystem 250 and the main tool controller 290 may be embodied within hardware, software, firmware or a combination thereof. In yet another embodiment, the platen controller 206, the carrier controller 276, the control subsystem 250 and the main tool controller 290 may be combined together, or grouped or sub-grouped in different combinations. Of course, however, the present invention is not limited to only the component described above. In other embodiments, the optical closed-loop control system 200 may include additional components than illustrated.

The control subsystem 250 is further configured to cause the CMP of the semiconductor wafer 280 to be adjusted based upon the at least one wafer state parameter. The control subsystem 250 may also be configured to control a movement of the wafer carrier 270 based upon one or more wafer state parameters. For purposes of the present invention, the phrase "control a movement" means to control a translation, a rotation, an orbit, in- or out-of-plane displacement or a combination thereof. Movement is considered in a vector sense, magnitude, direction and rates of change are implicit. These movements may be ascribed to the carrier 270 as well as to the platen 202. In the illustrated embodiment, the control subsystem 250 may control the carrier controller 276 via a control line 256 to cause a movement of the wafer carrier 270. In another embodiment, the control subsystem 250 may send a command to the main CMP tool controller 290 that may then engage the carrier controller 276 to act accordingly. The same may be done for the platen controller 206. The control subsystem 250 may also employ positioning and rotation speed data from the carrier sensor 278 in controlling the wafer carrier 270. In a related embodiment, the control subsystem 250 is configured to employ at least one wafer state parameter to individually control each of the controllable pressure zones 272, 273, 274 to adjust the pressure applied to different portions of the semiconductor wafer 280 in order to optimize the polishing of the semiconductor wafer 280.

The control subsystem 250 may also be configured to control a movement of the platen 202 based upon at least one wafer state parameter if the platen 202 is a moving platen. In the illustrated embodiment, the control subsystem 250 may control the platen controller 206 via a control line 255 to cause a movement of the platen 202. The control subsystem 250 may also employ positioning and rotation speed data from the platen sensor 208 in controlling the platen 202. Also, the control subsystem 250 may transmit closed-loop control information to the main CMP tool controller 290 via control/data line 258. In the illustrated embodiment, the control subsystem 250 may transmit closed-loop control information via the control/data line 258 to the main CMP tool controller to control and receive information concerning at least the wafer carrier 270, the plurality of pressure zones 272, 273, 274, the carrier controller 276, the platen 202, and the platen controller 206. The main CMP tool controller 290 may also communicate closed-loop control and status information to the CMP apparatus and other devices via a local area network (not shown).

A moving platen, such as the platen 202 illustrated in FIG. 2, has unique problems with maintaining the integrity of the optical paths, especially the optical paths between the optical probes 220, 222, 224 and the flash lamp 230 and the spectrograph 240. If the flash lamp 230 and/or the spectrograph 240 are not coupled to the moving platen, the optical cables would have to go through an optical rotating coupler connected to the spindle 204. The optical coupler may introduce noise or cause degradation of the optical signal that would lead to a less accurate analysis. In one embodiment, the present invention advantageously increases the integrity of the optical paths by coupling the flash lamp 230, the spectrograph 240 and at least a portion of the control subsystem 250 on the moving platen. In this configuration, the optical illumination fiber cable 232 of the optical probes 220, 222, 224 are directly connected to the flash lamp 230. Also, the optical collection fiber cable 242 of the optical probes 220, 222, 224 are directly connected to the spectrograph 240. The elimination of the optical rotating coupler and employing direct connections increases the integrity of the optical signals and, as such, increases the accuracy of the analysis.

As described above, the control subsystem 250 is configured to analyze real-time spectral reflectometry data obtained from the spectrograph 240 during the CMP process and determine at least one wafer state parameter therefrom. The control subsystem 250 may employ n-band analysis in analyzing the real-time spectral reflectometry data and determining the at least one wafer state parameter therefrom. In another embodiment, the control subsystem 250 may employ a transform analysis in analyzing the real-time spectral reflectometry data and determining the at least one wafer state parameter therefrom. In yet another embodiment, the control subsystem 250 may employ a metal breakthrough analysis in analyzing the real-time spectral reflectometry data and determining the at least one wafer state parameter therefrom. In still yet another embodiment, the control subsystem 250 may employ a model analysis in analyzing the real-time spectral reflectometry data and determining the at least one wafer state parameter therefrom. These analysis models are described in more detailed in FIGS. 10–25.

The control subsystem 250 may be further configured to perform a normalization using a reference wafer and employ the data obtained therefrom in at least the determination of ore or more wafer state parameters. The data from the normalization procedure is commonly composed of one or more spectra or an average of spectra. For example, the data from the normalization may be used as a target during the CMP processing of production semiconductor wafers. In another example, the normalization data is used to normalize the intensity of the reflected spectra. The method of acquisition of normalization spectra using a reference wafer is discussed in more detail in FIGS. 7 and 8A–D. In another embodiment, the control subsystem may be configured to adjust for attenuation of the light received due to a slurry 260 or a probe window, such as probe window 212, during the polishing of the semiconductor wafer 280. One type of attenuation of the light received is due to the presence of abrasive and/or colored metallic oxide particles in the slurry causing the light to scatter. Another type of attenuation of the light received is due to the fact that probe window has some opacity and may cause some scattering. These attenuations may be wavelength specific and non-uniform. One skilled in the art understands that attenuation of the light received reduces the ability to correctly interpret or detect the current condition of the semiconductor wafer 280. The present invention advantageously adjusts for attenuation of the light signals during the analysis process to increase the accuracy of the CMP process. A more detailed discussion of adjusting for the attenuation of the light received is discussed in association with FIG. 7 (Normalization method) and FIG. 13 (Transform Analysis method).

One skilled in the art should know that the placement of the elements of the optical closed-loop control system 200 are not limited to the locations illustrated. Nor is the routing of cables employed by the optical closed-loop control system 200 limited to the routing illustrated. Other embodiments of the present invention, the elements of the optical closed-loop control system 200 and associated cabling may be in any location and the location may be optimized in accordance with the requirements of a moving platen, such as maintaining gyroscopic stability.

Figure 3:
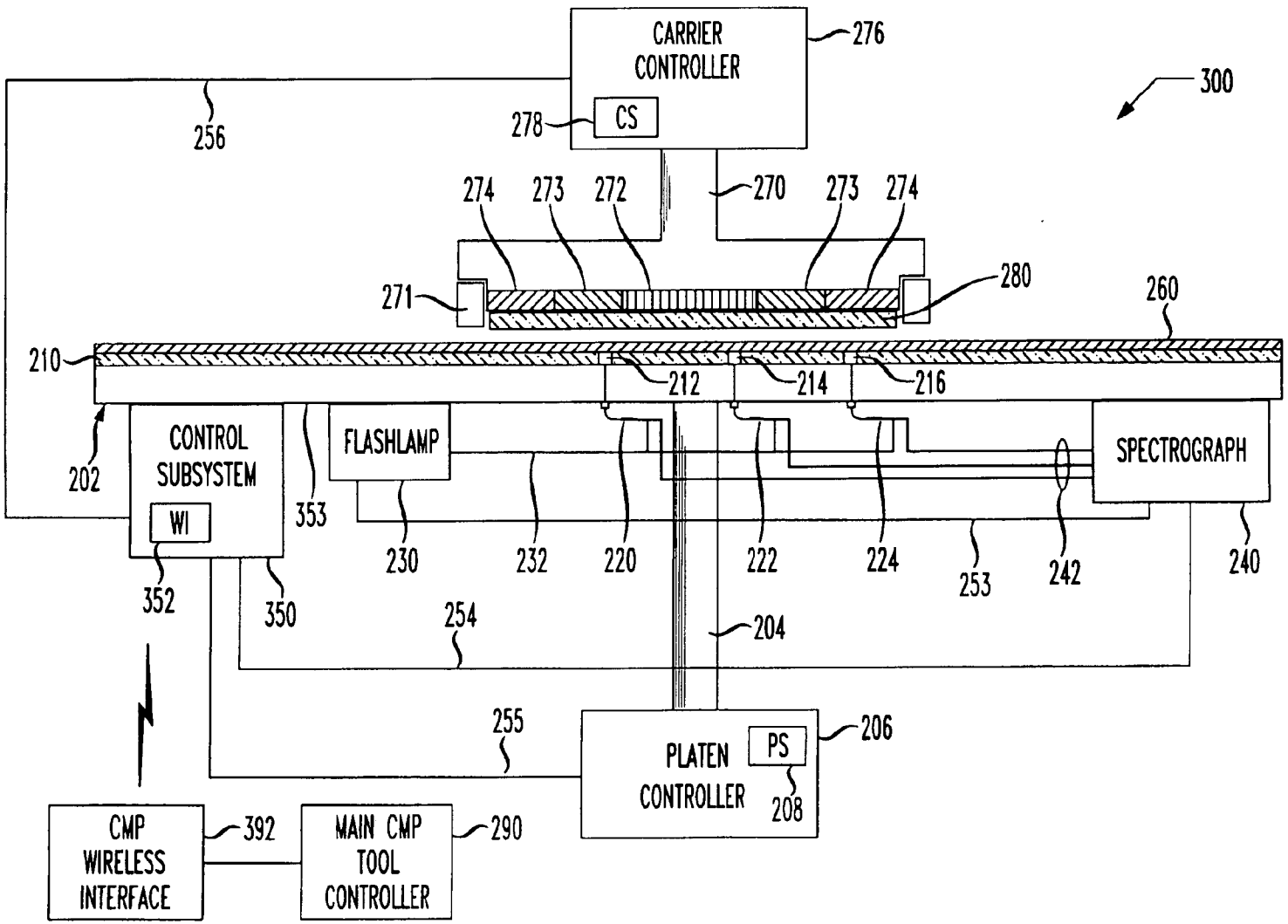
FIG. 3 illustrates an alternative embodiment of an optical closed-loop control system of FIG. 2 constructed in accordance with the principles of the present invention.

Turning now to FIG. 3, illustrated is an alternative embodiment of an optical closed-loop control system of FIG. 2, generally designated 300, constructed in accordance with the principles of the present invention. The optical closed-loop control system 300 is identical to and has the same functionality as the optical closed-loop control system 200 of FIG. 2 except for what is discussed below.

The optical closed-loop control system 300 includes a control subsystem 350 that is coupled to said platen 202, and is identical to the control subsystem 250 of FIG. 2. The control subsystem 350 is further configured to employ a wireless interface module 352 to transmit closed-loop control information to the CMP apparatus to control at least the wafer carrier 270. In the illustrated embodiment, the optical closed-loop control system 300 also includes a CMP wireless interface 392 coupled to the main CMP controller 290. The control subsystem 350 may transmit and receive closed-loop control information and status to/from the main CMP tool controller 290 via the wireless interface module 352 and the CMP wireless interface 392. The control subsystem 350 may still send and receive closed-loop control information and status to the carrier controller 276 and the platen controller 206. In a related embodiment, the control subsystem 352 may control at least a portion of the flash lamp 230 and receive data from the flash lamp via a control/data line 353.

The control subsystem 350 may also transmit closed-loop control information via the wireless interface module 352 to the CMP wireless interface module 392 and the main CMP tool controller 290 to control and receive information concerning at least the wafer carrier 270, the plurality of pressure zones 272, 273, 274, the carrier controller 276, the platen 202, and the platen controller 206. The CMP wireless interface module 392 may also communicate closed-loop control and status information to the CMP apparatus and other devices via a local area network (not shown). In yet another embodiment, a portion of the control subsystem 350 may be coupled to the platen 202 and the remaining portion of the control subsystem 350 may be located within the CMP apparatus or the main CMP tool controller 290 and communication between each portion of the control subsystem 350 may be via the wireless interface module 352 and the CMP wireless interface module 392.

Figure 4A:
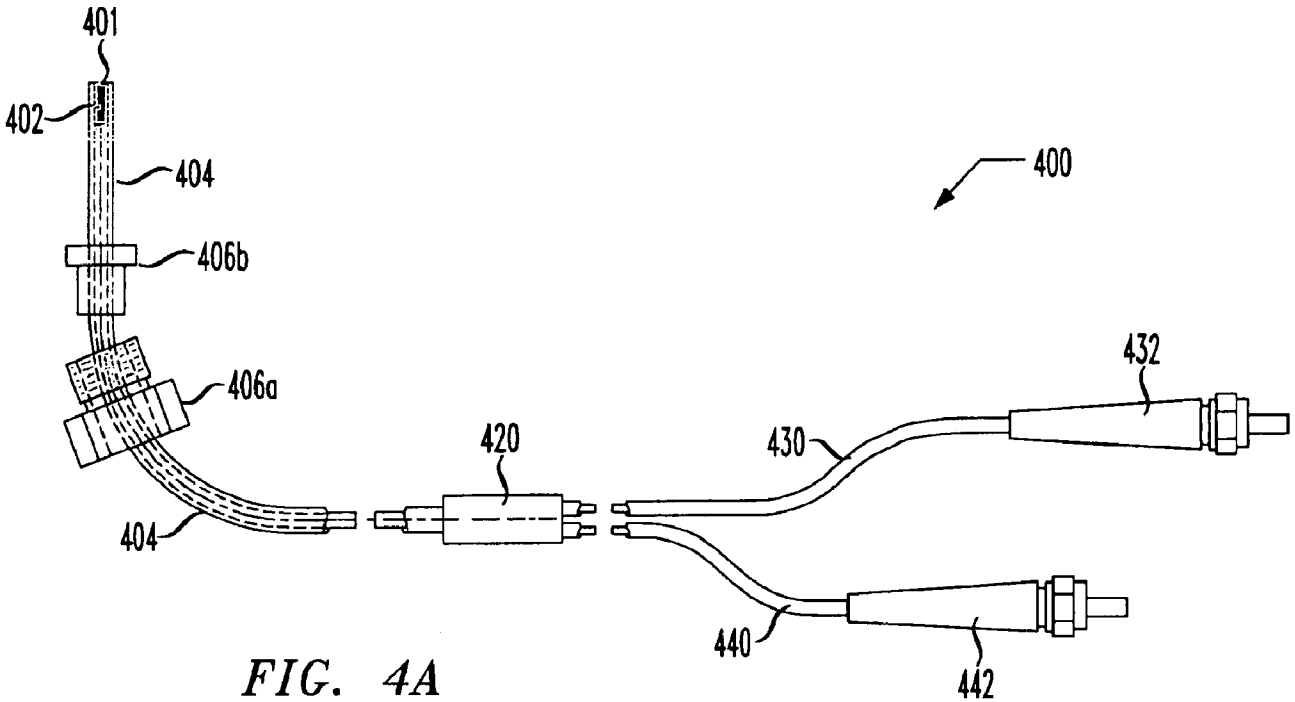
FIGS. 4A and 4B illustrate a plan-view and a cross-sectional view, respectively, of an embodiment of an optical probe constructed in accordance with the principles of the present invention.
Figure 4B:
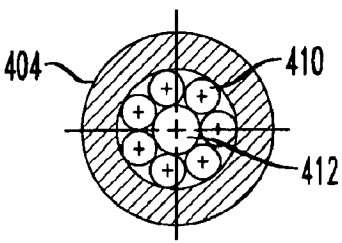

Turning now to FIGS. 4A and 4B, illustrated is a planview and a cross-sectional view, respectively, of an embodiment of an optical probe, generally designated 400, constructed in accordance with the principles of the present invention. The optical probe 400 includes a probe tube 404 that rigidly contains a portion of the optical probe fibers 410 and 412. The probe tube 404 also contains a lens 402 having one end planar with a distal end of the probe tube 404 forming a probe tip 401. The lens 402 is also rigidly coupled to the optical probe fibers 410 and 412. In one embodiment, the lens 402 may be configured to provide collimated light collection. In another embodiment, the lens 402 may be configured to provide collimated light illumination. In yet another embodiment, the lens 402 is an integral gradient index lens.

The optical probe 400 includes coupling means 406 that is configured to rigidly mount the probe tube 404 and the integral optical fibers 410 and 412 through a platen. The coupling means 406 allows for precise installation and adjustment, and also allows for optical contacting of the probe tip 401 with a probe window. The probe window may be one of the probe windows 212, 214, 216 of FIG. 2. This precise installation./adjustment and optical contacting with the probe window also allow the integrity of the optical path to be maintained. In one embodiment, the coupling means 406 may be a threaded mechanism such as a nut 406*a* coupled with a ferrule 406*b*. In another embodiment, the probe tube 404 and the coupling means 406 may be precisely adjusted/installed by use of a simple threaded mechanism such as a screw.

The probe tube 404 is also coupled to a transition tube 420. The transition tube 420 permits the bifurcation of the bundled optical collection fiber cable 412 and optical illumination fibers 410. Following the transition tube 420 the optical collection fiber 412 is encased in a protective jacket 430 that, along with connector 432, is designated the "return leg" or "spectrograph leg" of the probe 400. The name denotes the final device to which the leg of the probe 400 is connected: namely a spectrograph or other light detection means. For example, the spectrograph 240 of FIG. 2. Similarly, the optical illumination fibers 410 are encased in a protective jacket 440 that along with connector 442 are designated the "illumination leg" or "flash lamp leg" of the probe 400. Here the name denotes the final device to which the leg of the probe 400 is connected, namely the flash lamp or other light source. For example, the flash lamp 230 of FIG. 2. The present invention advantageously employs direct coupling of the legs of the probe 400 to a spectrograph and a flash lamp in order to maintain the integrity of the optical path from the probe tip to the spectrograph and from the flash lamp to the probe tip. One skilled in the art should note that the addition of any extra connections in the fiber optic cables has the effect of degrading both the intensity of the illuminating and collected light signals. For a typical SMA905 type optical interconnects, available from AMP, the loss is typically 0.5 dB (~12.5%) per connection. Adding one patch cable requires the addition of two connections for a total loss of signal of about 25%. The close placement of the spectrograph and flash lamp minimize the number of connections to the minimum required, namely two.

Turning now to FIG. 4B, illustrated is a cross-sectional view of the optical probe cable of FIG. 4A constructed in accordance with the principles of the present invention. The probe tube 404 supports an optical collection fiber 412 at its core. In one embodiment, the optical collection fiber 412 may be a 300 micron fiber. The optical collection fiber 412 may be coupled to the lens 402 of the optical probe 400. The probe tube 404 also encloses a plurality of optical illumination fibers 410 adjacent to the optical collection fiber 412 and are configured to provide illumination. In the illustrated embodiment, the optical illumination fibers 410 annularly encase the optical collection fiber 412. The optical illumination fibers 410 may be 200 micron fibers. In a related embodiment, the plurality of optical illumination fibers 410 may be configured to provide collimated illumination. Also, the optical illumination fibers 410 may extend to the probe tip 401.

Figure 5A:
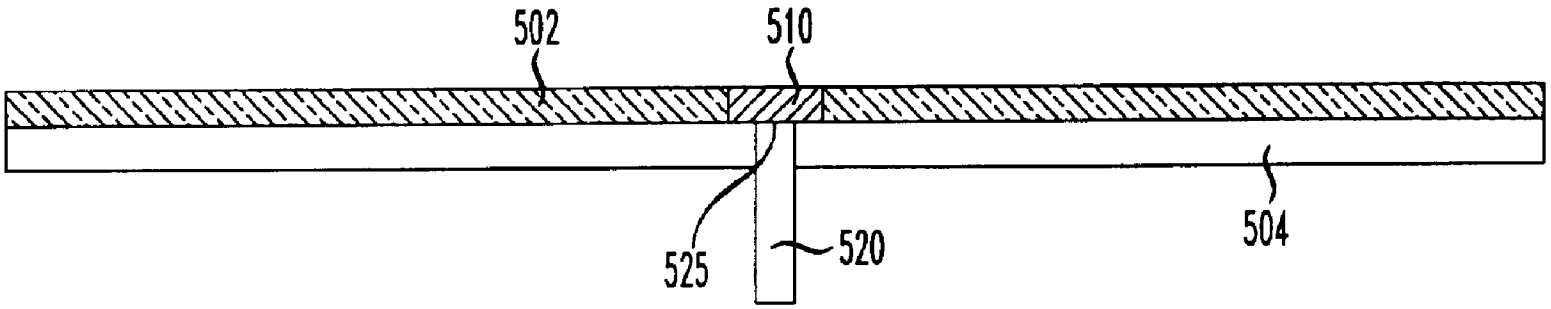
FIGS. 5A and 5B illustrate exemplary placements of a probe tip to achieve an impaction into the probe window according to the principles of the present invention.
Figure 5B:
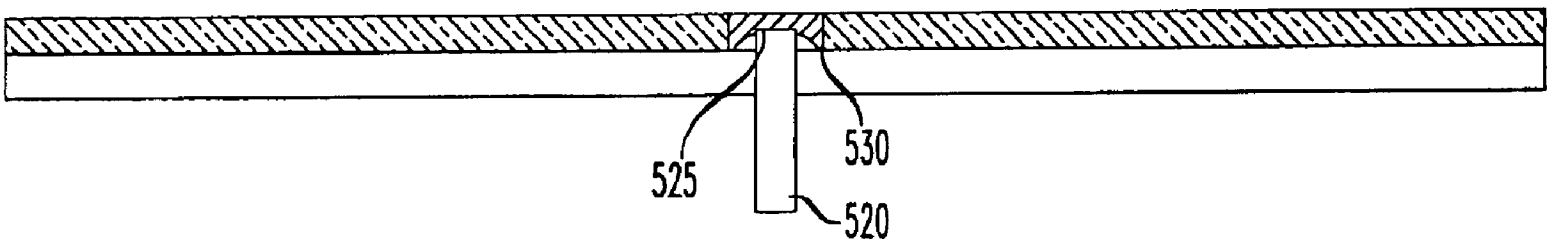

Turning now to FIGS. 5A and 5B, illustrated are exemplary placements of a probe tip to achieve an impaction into the probe window according to the principles of the present invention. Illustrated is a platen 504 with a conventional polishing pad 502 coupled to a ton surface of the platen 504. Positioned within the polishing pad 502 is a probe window 510. The probe window 510 is positioned over an optical probe 520 rigidly mountable through the platen 504. The placement or positioning of a tip 525 of the optical probe 520 in the platen 504 depends upon achieving a specific range of impactions into the probe window 510. It is desirable to maintain contact between the probe window 510 and the probe tip 525. If there is a gap between the probe window 510 and the probe tip 525, the optical path continuity may become diminished or impeded due to the use of a slurry in the CMP process. The transmission properties of the optical path may also become unstable during the wafer processing as the CMP process mechanically changes the gap between the probe tip 525 and the probe window 510 or forces slurry, air, or other fluids in the gap. This in turn may adversely affect the analysis of the light received by the optical probes and a spectrograph. One or more of these instability conditions are often observed during the data collection for normalization from a reference wafer as described in FIG. 7.

The lower surface of the probe window 510 may be of three basic shapes: planar, convex, and concave. FIG. 5A illustrates the minimum height for the probe 520 to extend above the surface of the platen 504. For probe windows with planar or convex surfaces, as illustrated by probe window 510, the minimum height is 0.0 inches. For concave surfaces this minimum height should be increased to compensate for the curvature of the surface as by probe window 530 of FIG. 5B. To ensure impaction and to simultaneously minimize the effects of altering the contour of the top surface of the probe window 510, the probe 520 should not extend into the probe window 510 more than about 0.02 inches or equivalently about 10% of the probe window 510 thickness that is typically 0.040 to 0.180 inches. Distorting the top surface of the probe window 510 has the effect of creating a localized pressure point of the wafer that result in altered polishing performance or a dmaged wafer. With the probe 520 properly impacted into the probe window 510, the normalization procedure of FIG. 7 and the corrections, such as those discussed in FIG. 13, may be readily applied to compensate or correct for attenuations from the window, probe tip/window interface, and slurry. Of course, however, the location and positioning of the maximum and minimm heights for the probe tips illustrated in FIGS. 5A and 5B are for illustrative purposes and the present invention is not limited to these illustrated locations and positions.

Figure 6:
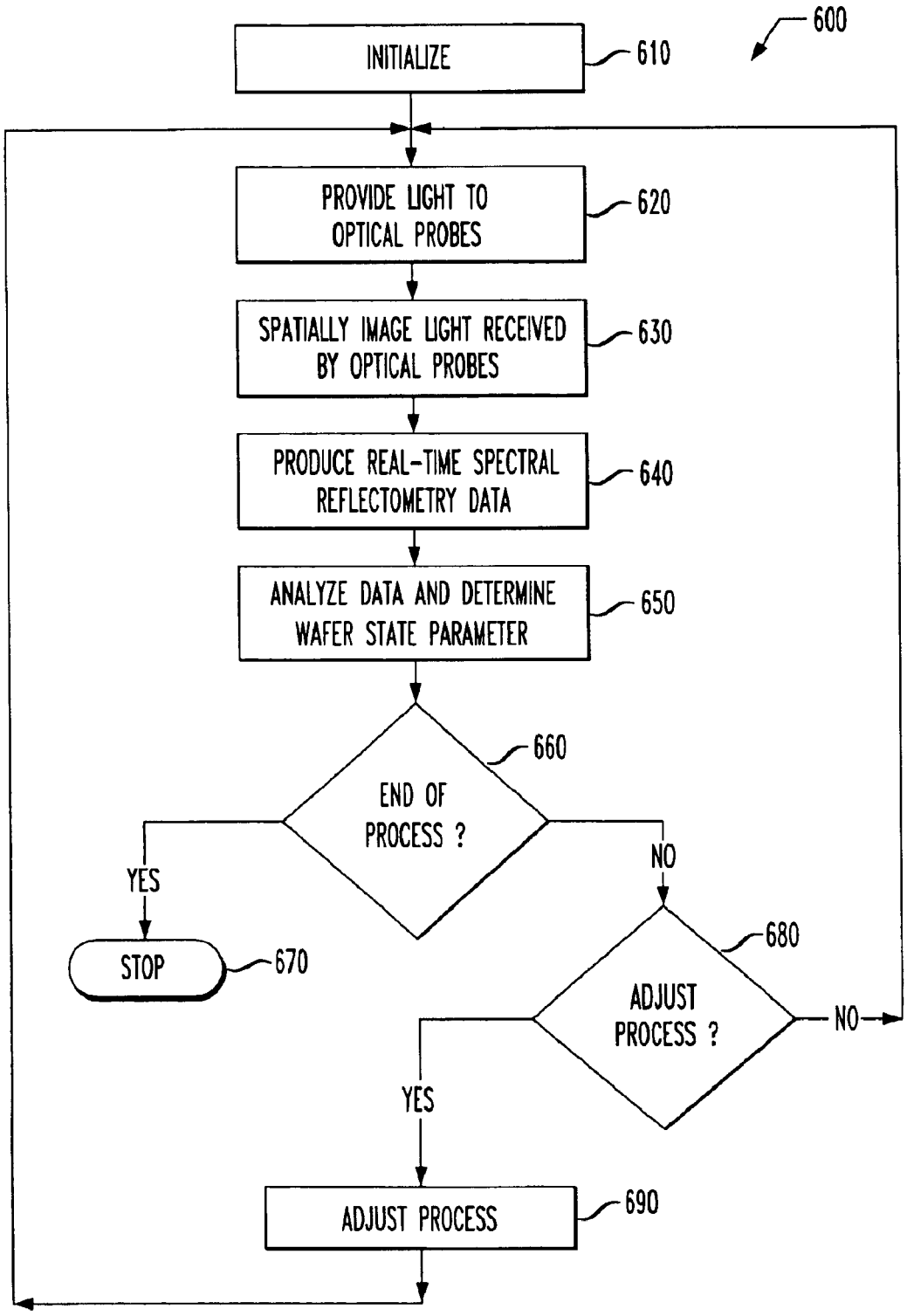
FIG. 6 illustrates a flow diagram of an embodiment of a method of operating an optical closed-loop control system for use with a chemical mechanical polishing apparatus for polishing a semiconductor wafer conducted according to the principles of the present invention.

Turning now to FIG. 6, illustrated is a flow diagram of an embodiment of a method of operating an optical closed-loop control system, generally designated 600, for use with a chemical mechanical polishing (CMP) apparatus for polishing a semiconductor wafer conducted according to the principles of the present invention. The CMP apparatus may have a platen, a polishing pad coupleable with a top surface of the platen and a wafer carrier. In FIG. 6, the method 600 first performs intitialization in a step 610.

After initialization, the method 600 provides light to each of the optical probes employed by the optical closed-loop control system in a step 620. In one embodiment, the light is provided by a flash lamp and minimizes an exposure time of the light onto the semiconductor wafer. In a related embodiment, the optical probes may include a plurality of illumination fibers that provide collimated illumination. In yet another embodiment, the optical probes may include collimated illumination optics. Next, the method 600 spatially images the light received by the optical probes after reflection from the wafer surface in a step 630. In one embodiment, the method 600 spatially images the light received by the optical probes to a common charge-coupled device (CCD) of spectrograph. In a related embodiment, the optical probes may include collimated collection optics to collimate the reflections of the light received by the optical probes. The method 600 then produces real-time spectral reflectometry data from the spatially imaged light in a step 640.

The method 600 analyzes the real-time spectral reflectometry data and determines at least one wafer state parameter therefrom in a step 650. In one embodiment, the method 600 may employ a n-band analysis in analyzing the real-time spectral reflectometry data and determining at least one wafer state parameter. In a second embodiment, the method 600 may employ a transform analysis in analyzing the real-time spectral reflectometry data and determining at least one wafer state parameter. In a third embodiment, the method 600 may employ a metal breakthrough analysis in analyzing the real-time spectral reflectometry data and determining at least on wafer state parameter. In a fourth embodiment, the method 600 may employ a model analysis in analyzing the real-time spectral reflectometry data and determining at least one wafer state parameter. Of course, however, other analysis models may be employed by the method 600 to analyze the data and determine at lease one wafer state parameters.

Next, the method 600 employs the at least one wafer state parameter to determine if it has reached the end of the process in a decisional step 600. If the end of the process has been reached, the method 600 stops in a step 670. If the method 600 determined that it has not reached the end of the process, the method 600 then, employing the at least one wafer state parameter, determines if the process is to be adjusted in a step 680. If the process is to be adjusted, the method 600 then employs the at least one wafer state parameter to adjust the process in a step 690. In one embodiment, the optical closed-loop control system may include a wafer carrier having a plurality of controllable pressure zones. The method 600 employs the at least one wafer state parameter to individually control each of the plurality of controllable pressure zones to adjust the pressure applied to different portions of the semiconductor wafer in order to optimize the polishing of the semiconductor wafer.

The method 600 may also adjust the process by controlling a movement of the wafer carrier based upon the at least one wafer state parameter. In yet another embodiment, the method 600 may adjust the process by controlling a movement of a moving platen based upon the at least one wafer state parameter, if the CMP apparatus is equipped with a moving platen. In still yet another embodiment, the method 600 may adjust the process by controlling a movement of the wafer carrier and a movement of a moving platen based upon the at least one wafer state parameter, if the CMP apparatus is equipped with a movable wafer carrier and a movable platen.

After adjusting the process in the step 690, the method returns to provide light to the optical probes again in the step 620. In another embodiment, the method 600 may also perform as part of step 650 a normalization of the real-time spectral data using the data collected from a reference wafer (as per FIG. 7) and employ the data obtained from the normalization in at least the determination of the at least one wafer state parameter.

One skilled in the art should know that the present invention is not limited to adjusting the process as described above. In other embodiments, the present invention and method may adjust or cause to adjust other devices or parameters of the CMP process. Also, other embodiments of the present invention may have additional or fewer steps than described above.

Figure 7:
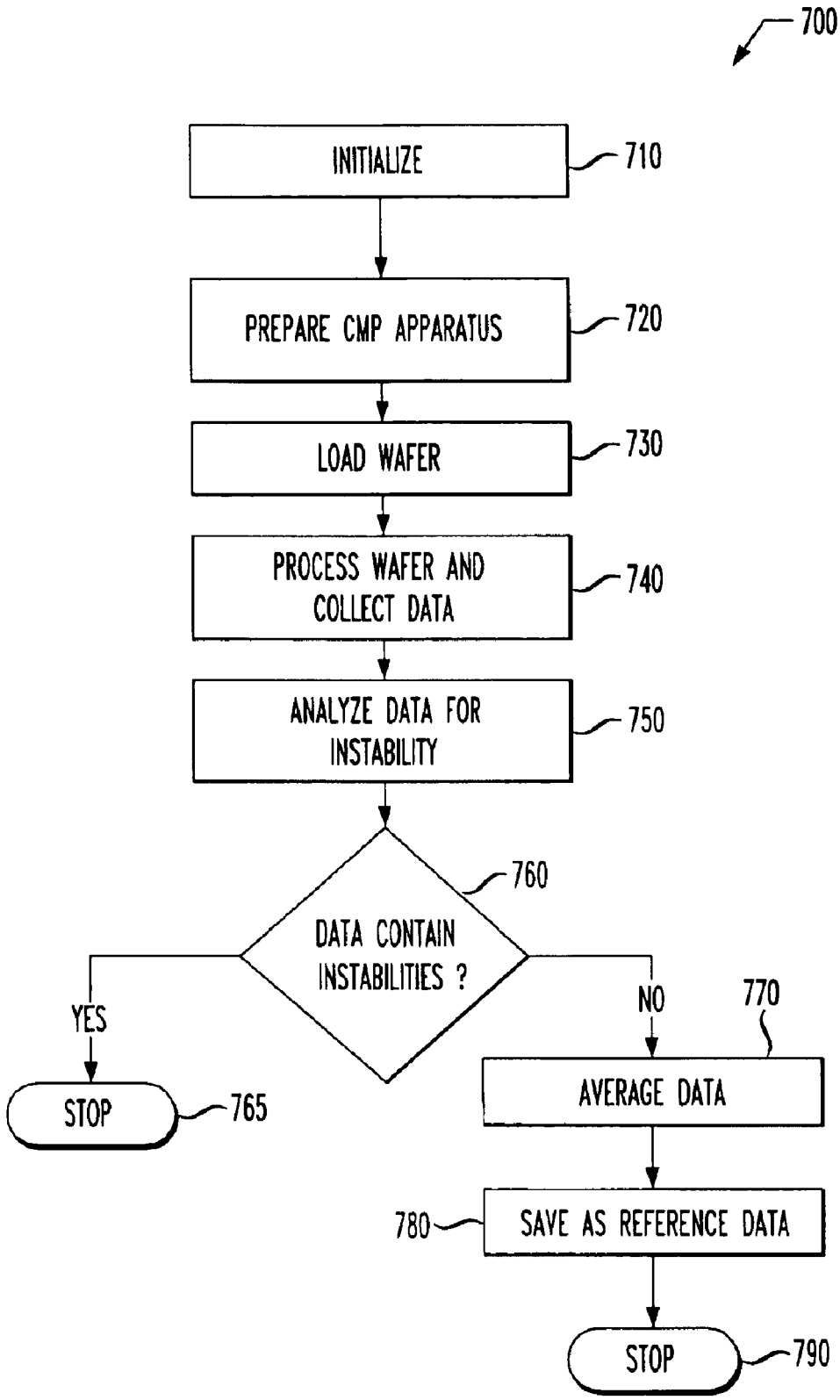
FIG. 7 illustrates a flow diagram of an embodiment of a method of collecting normalization data from a reference wafer for use with a chemical mechanical polishing (CMP) apparatus conducted according to the principles of the present invention.

Turning now to FIG. 7, illustrated is a flow diagram of an embodiment of a method collecting normalization data using a reference wafer, generally designated 700, for use with a chemical mechanical polishing (CMP) apparatus conducted according to the principles of the present invention. In one embodiment, the CMP apparatus may be a CMP apparatus that incorporates the optical closed-loop control system illustrated in FIG. 2 or FIG. 3. In FIG. 7, the method 700 first performs initialization in a step 710.

After initialization, the CMP apparatus is prepared in a step 720. In preparing the CMP apparatus, the CMP apparatus should be configured to operate in the same or substantially similar manner as the CMP apparatus would be in processing production wafers. It is important that the kinematical, optical and hydrodynamical conditions of the wafer, slurry, probe window, and probe interface are substantially consistent from the reference wafer to the production wafers. If the conditions are not substantially consistent, then analysis of the CMP process may produce flawed results.

The requirement for the usage of the same CMP process conditions permits the method 700 to remove a majority of the attenuation effects caused by the slurry, such as scattering due to oxidation of metal in the slurry. The method 700 may also remove a majority of the attenuation effects cause by the probe window, and window-probe interface. More specifically, the probe window is a generally transparent material often 0.040 to about 0.200 inches thick and typically has a wavelength transmission range is from about 200 nm (UV) to about 2000 nm (NIR). This includes the visible range where most current analysis is performed. The probe window is often made from polyurethane, acrylics, polycarbonates, nylons and polyesters or some combinations of these materials. These materials typically cause some scattering and attenuation of light signals as the light passes through the probe window. The attenuation is defined relative to the thickness (T) of the material and its extinction coefficient $k(\lambda)$ for any specific wavelength. A common form of the transmission may be give as $T=Exp(-k*T)$ therefore if a thicker window is used the attenuation is greater. Similarly for the scattering in the material; the scattering may be defined as the property of the material whereby a normally incident collimated beam of light is distorted as it passes through the material. This typically results in a decrease in the degree of collimation of the beam as well as spatial and wavelength-specific photometric changes to the distribution of the beam. For example, strong scattering will redden the center of the beam since blue wavelengths are most strongly scattered.

In addition, the CMP process causes the surfaces of the probe window to be worn. This is especially true of the top surface, which is abrasively conditioned (cleaned and textured) by the CMP tool, often for each wafer. This conditioning process produces a series of scratches on the top surface of the probe window. These scratches and their interaction with the slurry and particles add to the scattering and attenuation problems. The present invention, in one embodiment, advantageously accounts and adjusts for these problems during the normalization process and other processes defined later. Additional information concerning probe windows is discussed in the published PCT application entitled "POLISHING PAD WINDOW FOR A CHEMICAL-MECHANICAL POLISHING TOOL," PCT Publication No. WO 01/94074 Al, which is hereby incorporated by reference in its entirety.

Mathematically, the attenuation can be equated to a function that is multiplied by the reflected light signal as follows:

$$S = (1 - F_a) \times I_{fl} \times R_x$$

wherein, S is the measured reflected light spectrum, $I_{f1}$ is the flash lamp spectrum, $R_x$ is the reflectance of a wafer, and $F_a$ is the total wavelength-dependent attenuation of the optical path. $R_x$ may designate a reference wafer ($R_{norm}$) or a wafer being processed ($R_{wafer}$). The typical normalization procedure includes the division of the spectrum S by that spectrum S' that was recorded as a reference or normalization spectrum, i.e. S/S'. This function should result in the ration $R_{wafer}/R_{norm}$, since $R_{norm}$ is commonly known (the reference wafer is most often a bare silicon wafer) then $R_{wafer}$ is uniquely determined. However, if the same process conditions are not used then the attenuation effects are not equal to $F_a$ but equal to some different $F_a'$. Then the ratio is then $(R_{wafer}/R_{norm})*(F_a'/F_a)$ and the normalized signal is now distorted and $R_{wafer}$ is not uniquely determined.

Next, the reference wafer is loaded into the CMP apparatus in a step 730. Typically is bare silicon or oxide wafer is loaded into a wafer carrier of the CMP apparatus. In other embodiments, other types of wafers may be used if the wafer type is clearly defined and the optical properties of the substrate and film layers of the wafer are known. The method 700 then processes the wafer and collects data about the process in a step 740. In one embodiment, the wafer is processed for a known period of time. For a bare silicon wafer the time period is typically one minute. For an oxide film wafer, the time period should be long enough for at least a few thousand Angstroms of material to be polished from the wafer. In one embodiment, the data may be collected by the optical probes and the spectrograph of FIG. 2 or FIG. 3.

The collected data is then analyzed for instability in a step 750. Instability may include oscillations in the shape of the spectrum and the fluctuations in the intensity of the spectrum. Instabilities are typically indicative of problems with the optical stability of the CMP apparatus and control system that should be corrected prior to further operation. See FIGS. 8A–D for an example of instability problems isolated from reference data of a bare silicon wafer. In one embodiment, the collected data may be analyzed by the control subsystem of FIG. 2. Next, the method 700 determines if the collected data contains significant instabilities in a decisional step 760. A specific example of a significant instability is if the time variation of the data collected from a bare silicon wafer has a standard deviation that is greater than or equal to 5% of the averaged spectral signal. If the collected data contains significant instabilities, the method 700 stops processing in a step 765. This allows for analysis and rectification of the cause of the instabilities.

If the collected data does not contain significant instabilities, the method 700 then averages the collected data in a step 770. The method 700 averages the time series of the collected data, excluding definable first and last time periods of data collected to create the reference data. The first and last time periods of the data collection times are commonly prone to changes in the slurry flow dynamics or mechanical dynamics of the CMP apparatus that are not typical of the majority of the CMP process. The method 700 than saves the averaged data as the reference data in a step 780. The reference data may be used in the analysis of the production wafers during the CMP process. The method 700 then stops processing in a step 790.

One skilled in the art should know that the present invention is not limited to processing and collecting data based on a time period. In other embodiments, the present invention and method may process the wafer and collect data based on other predetermined criteria. Also, other embodiments of the present invention may have additional or fewer steps then described above.

Figure 8A:
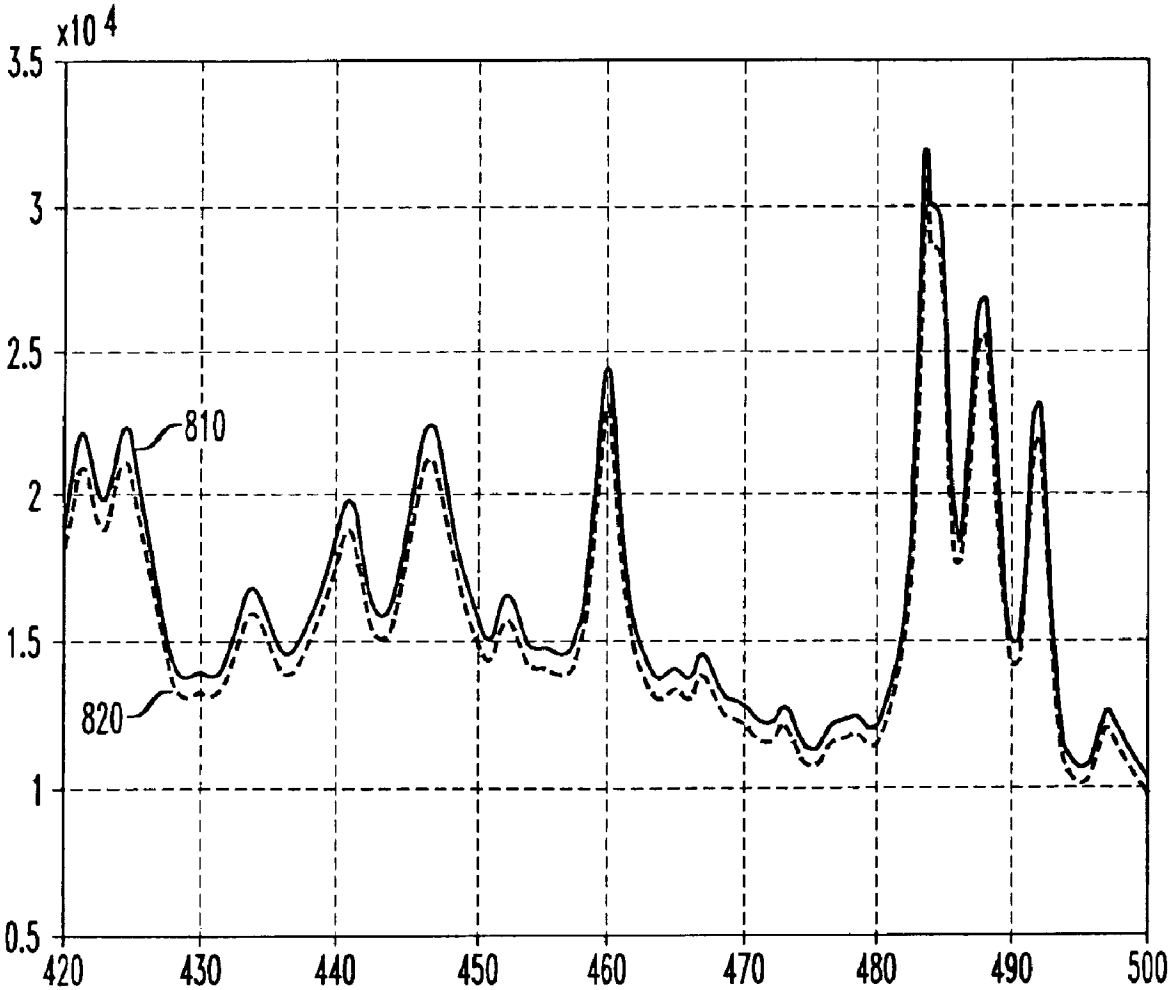
FIGS. 8A–D illustrate exemplary graphs of acceptable and unacceptable reference spectra for a bare silicon reference wafer obtained by the method of FIG. 7.
Figure 8B:
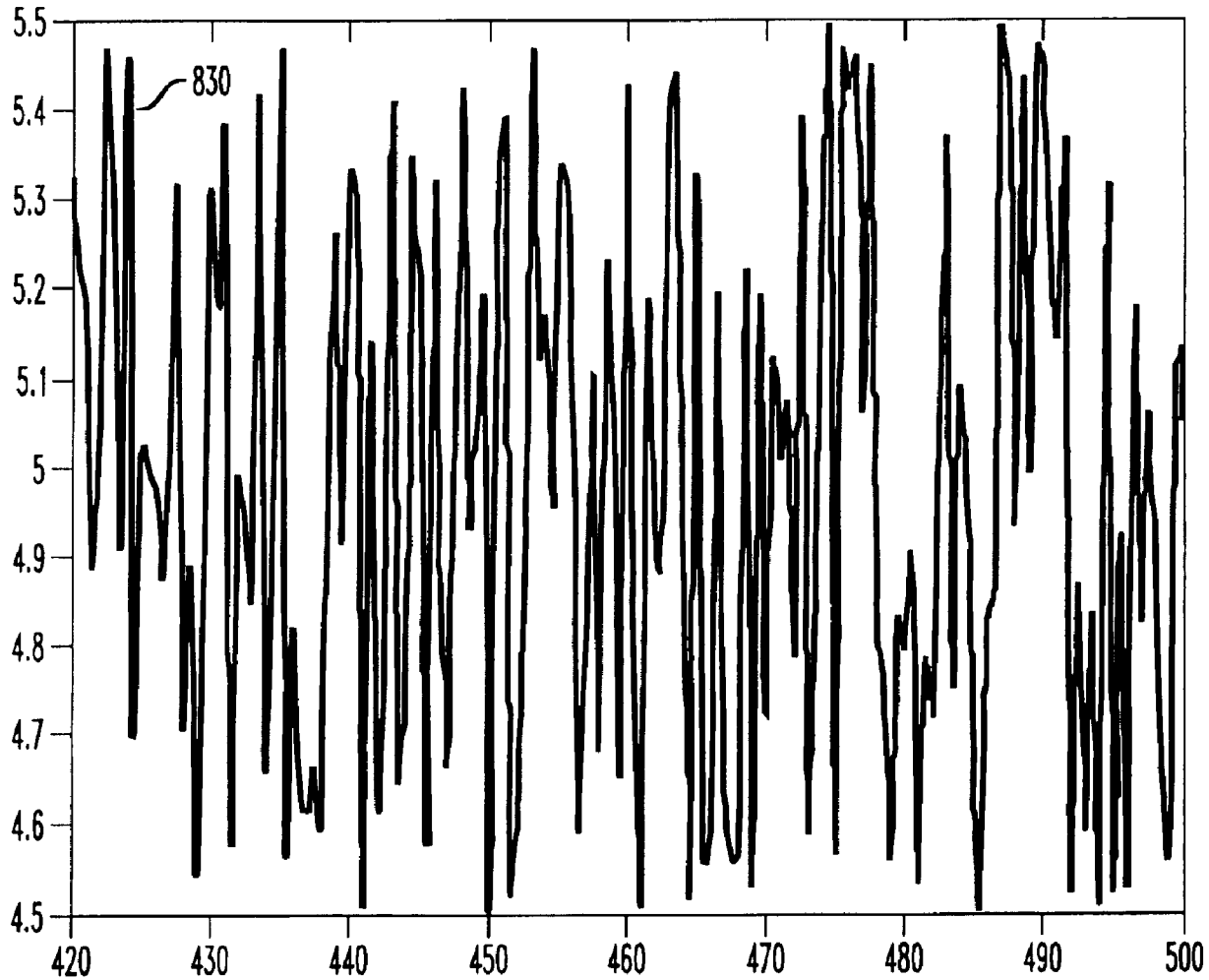

Turning now to FIGS. 8A–D, illustrated are exemplary graphs of acceptable and unacceptable reference spectra for a bare silicon reference wafer obtained by the method of FIG. 7. These spectra are shown plotted from 420–500 nm for brevity. The spectra 810 of FIG. 8A represents the averaged signal for the collected normalization time series of spectra. (See FIG. 7, Step 770). The spectrum 820 is an individual sample spectra that portrays the maximum excursion from the average data. This variation is typically considered acceptably small. FIG. 8B illustrates a percent difference plot 830 for the spectra 810 and 820 of FIG. 8A. The percent difference is randomly distributed and is about 5%. Typically, differences larger than what is illustrated in FIG. 8B are suspect and otherwise deemed unacceptable.

Figure 8C:
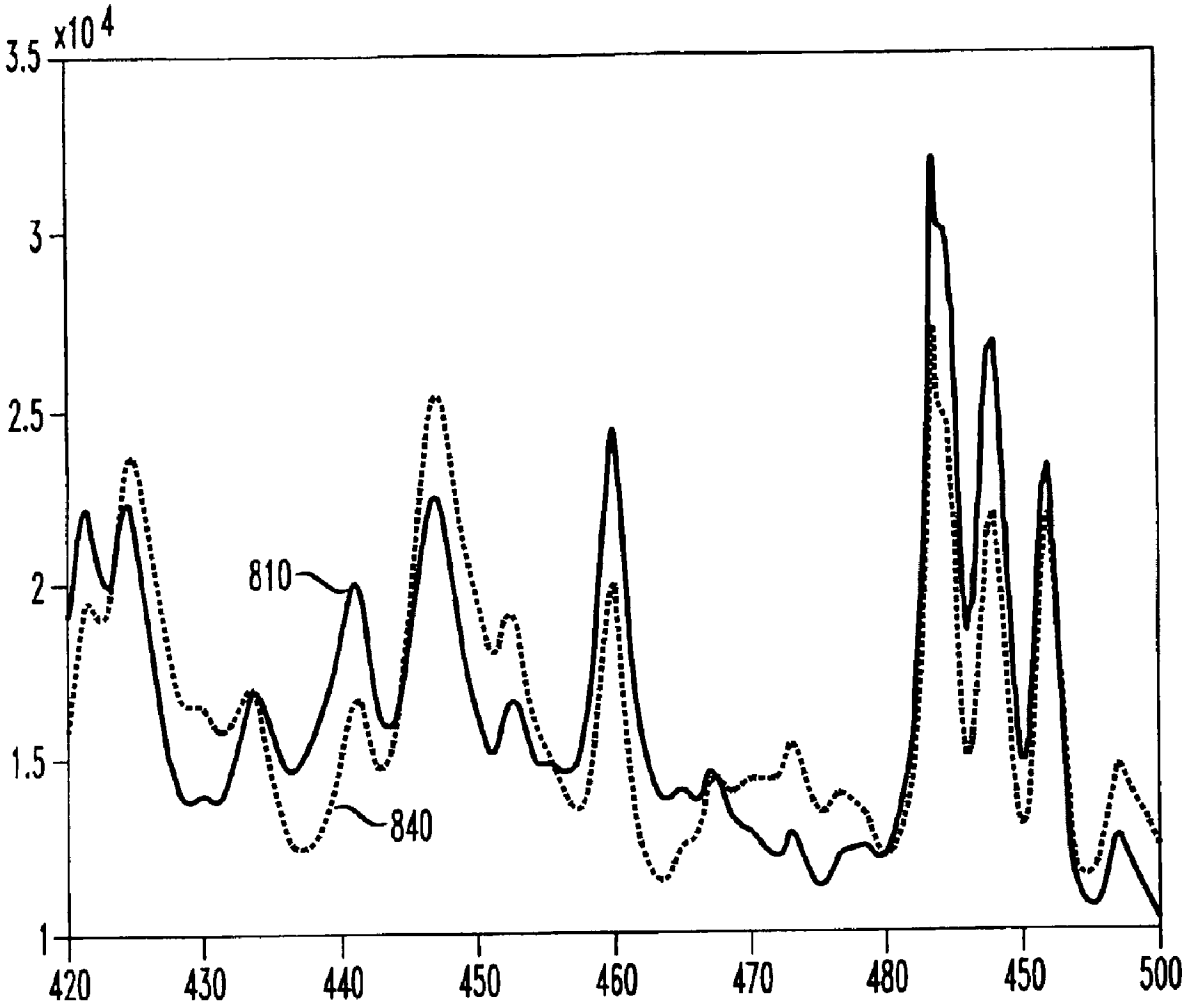
Figure 8D:
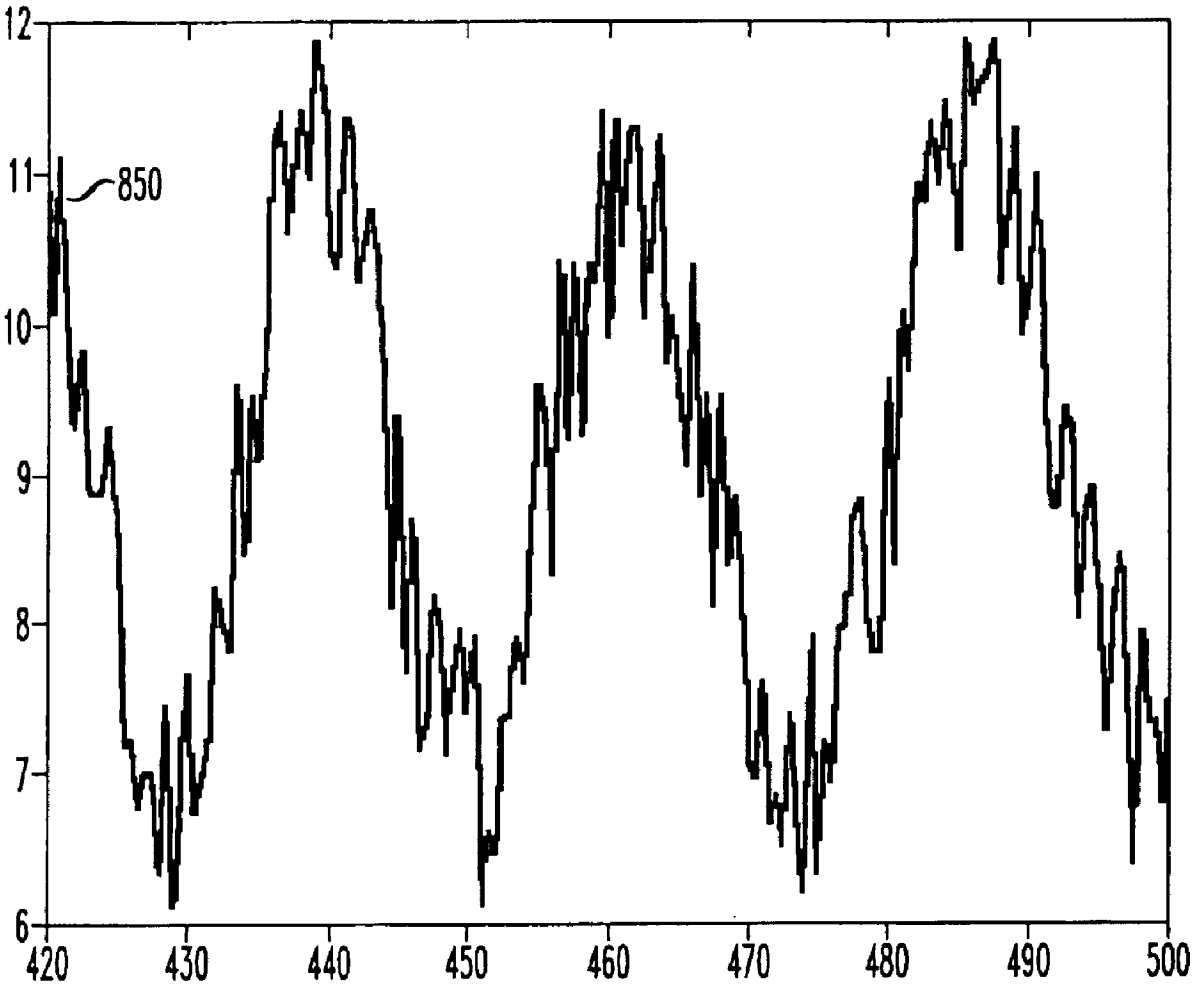

In FIG. 8C, the spectra 810 represents the averaged signal for the collected normalization time series of spectra. The spectra 840 is an individual sample spectra that portrays an excursion from the average data. FIG. 8D illustrates a percent difference plot 850 for the spectra 810 and 840 of FIG. 8C. The percent difference in this example is about 9% and is not randomly distributed. The collected set of normalization data represented by spectra 840 is unacceptable due to the size of the difference as well as the presence of structure. The structure may be due to an instability in the optical path (probe window, fiber, etc.) that should be corrected prior to operation of the CMP system. Of course, however, the spectra illustrated in FIGS. 8A–D are for illustrative purposes only and the present invention is not limited to the exact spectra illustrated.

Figure 9A:
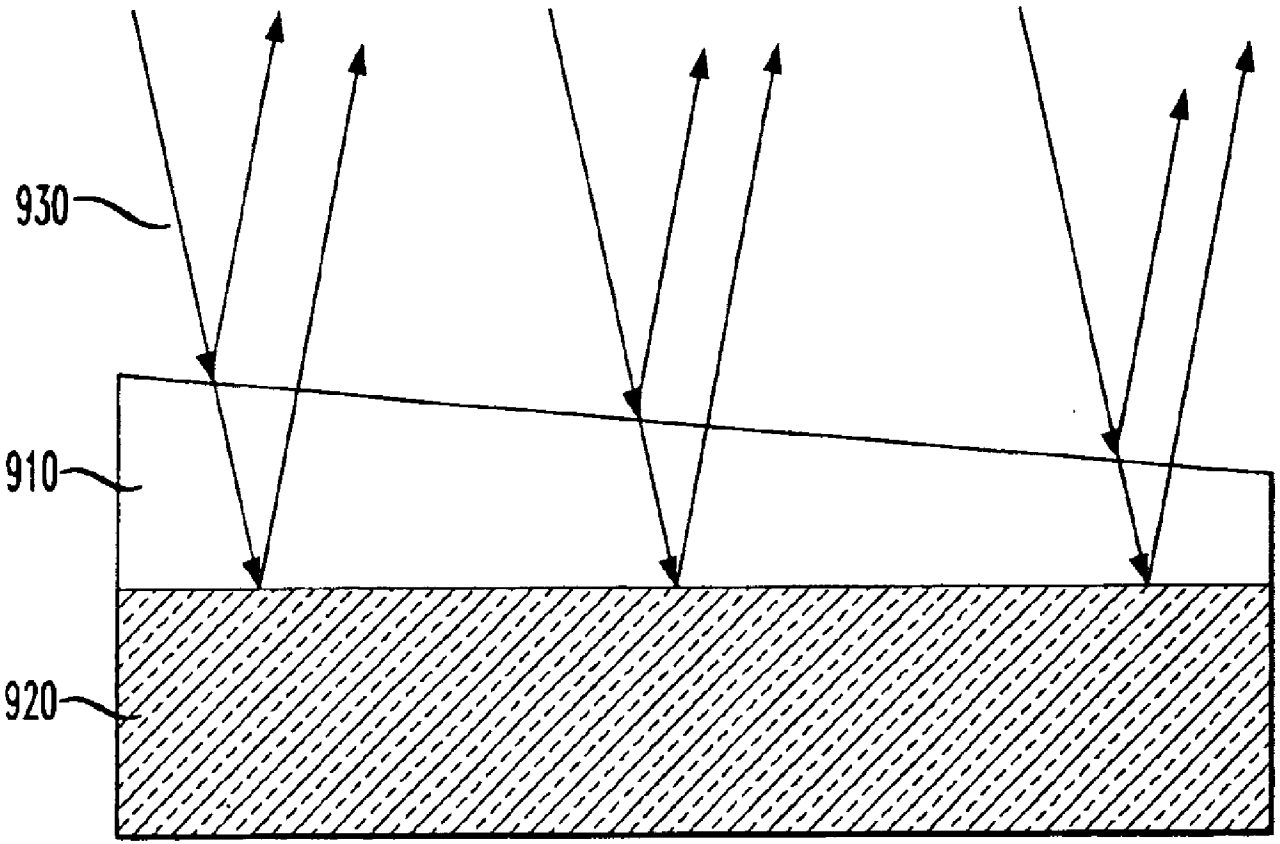
FIGS. 9A–C illustrate a model and graphs that discuss how a flash lamp in combination with optical probes provide sampling spot isolation, thereby preserving the interference contrast of reflected light according to the principles of the present invention.
Figure 9C:
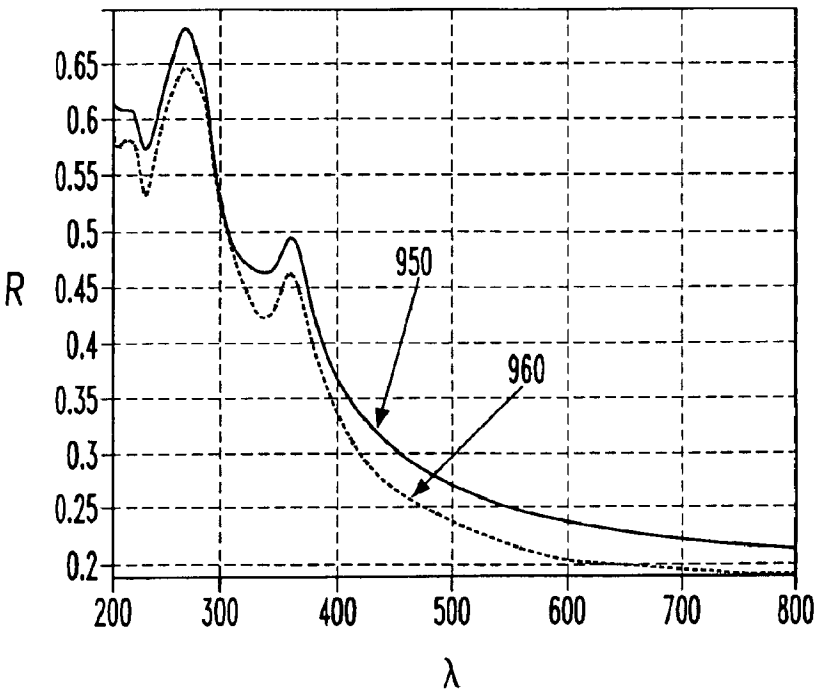
Figure 9B:
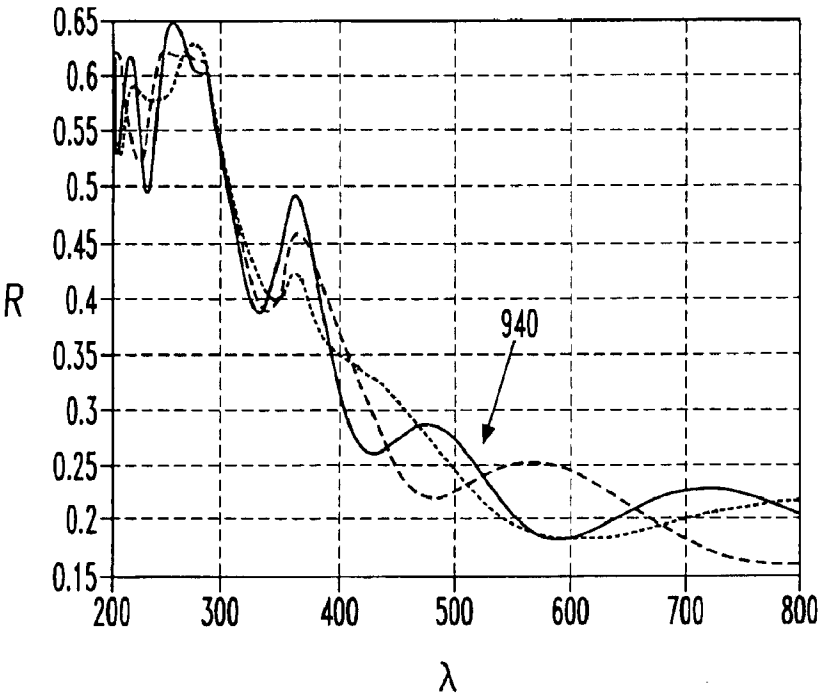

Turning now to FIGS. 9A–C, illustrated are a model and graphs that discuss how a flash lamp in combination with optical probes provide sampling spot isolation, thereby preventing interference contrast of reflected light according to the principles of the present invention. The preservation of the interference contrast is dependent on a probe spot size and a total area of the wafer sampled during a traverse of the spot over a wafer, FIG. 9A illustrates a simplified model of the optical interference from a single layer silicon dioxide film 910 deposited over a silicon wafer substrate 920. FIG. 9A also illustrates how selected individual light rays that comprise a large sampled spot on the wafer will reflect and interfere upon interaction with a film of nonuniform thickness.

The silicon dioxide film 910 has a gradient in thickness that is typical of semiconductor films processed by CMP.

The reflectometry data collected over such an area will have reduced interference contrast due to the incoherent summation of the reflected light 930. FIG. 9B illustrates normalized reflectance spectra 940 for a limited series of silicon dioxide thicknesses within the sampled spot. More specifically, the spectra 940 illustrate the theoretical absolute thickness of the modeled films, where one curve represents each different thickness as shown in FIG. 9A. Measuring the reflectometry data over the area shown in FIG. 9A yields, due to loss of interference contrast, the averaged reflectance spectrum 950 illustrated in FIG. 9C, which is the average of the normalized reflectance spectra 940. This averaged reflectance spectrum 950 is very similar to the spectrum of bare silicon 960 also illustrated in FIG. 9C. In this example, the derived measurement of a wafer state parameter such as thickness of the silicon dioxide film 910 will be erroneous due to the reduced interference contrast. Also, the analysis will determine that the film is very thin or does not exist on the substrate 920.

Since the wafer in a CMP tool moves, it is best to minimize the exposure time of the light signal onto the wafer. This further reduces the loss of contrast due to averaging of the non-uniformity of the wafer over the trajectory of the sampled spot. This is accomplished by the use of a light source with a very short exposure time, namely a flash lamp or very fast megahertz chopped CW lamp. In another embodiment, a very fast CCD or mechanically or electronically (CMOS) shuttered detector could be used. With the light now considered instantaneous, the probe diameter (spot size) may be selected. A rule may be developed to relate the planarization length to the limits for the probe diameter as well as the allowable maximum exposed and sampled wafer area. The planarization length is the characteristic length over which a stepped feature on the surface of the wafer is planarized. In other words the planarization length is the feature size over which the step height of that feature is reduced to zero. A typical range for planarization lengths may be from 3 to 10 mm. This condition allows the sampling to incoherently sum the reflectances of the different regions only over a region that is representative of the condition of the wafer and may be reduced to a wafer state parameter.

Figure 10:
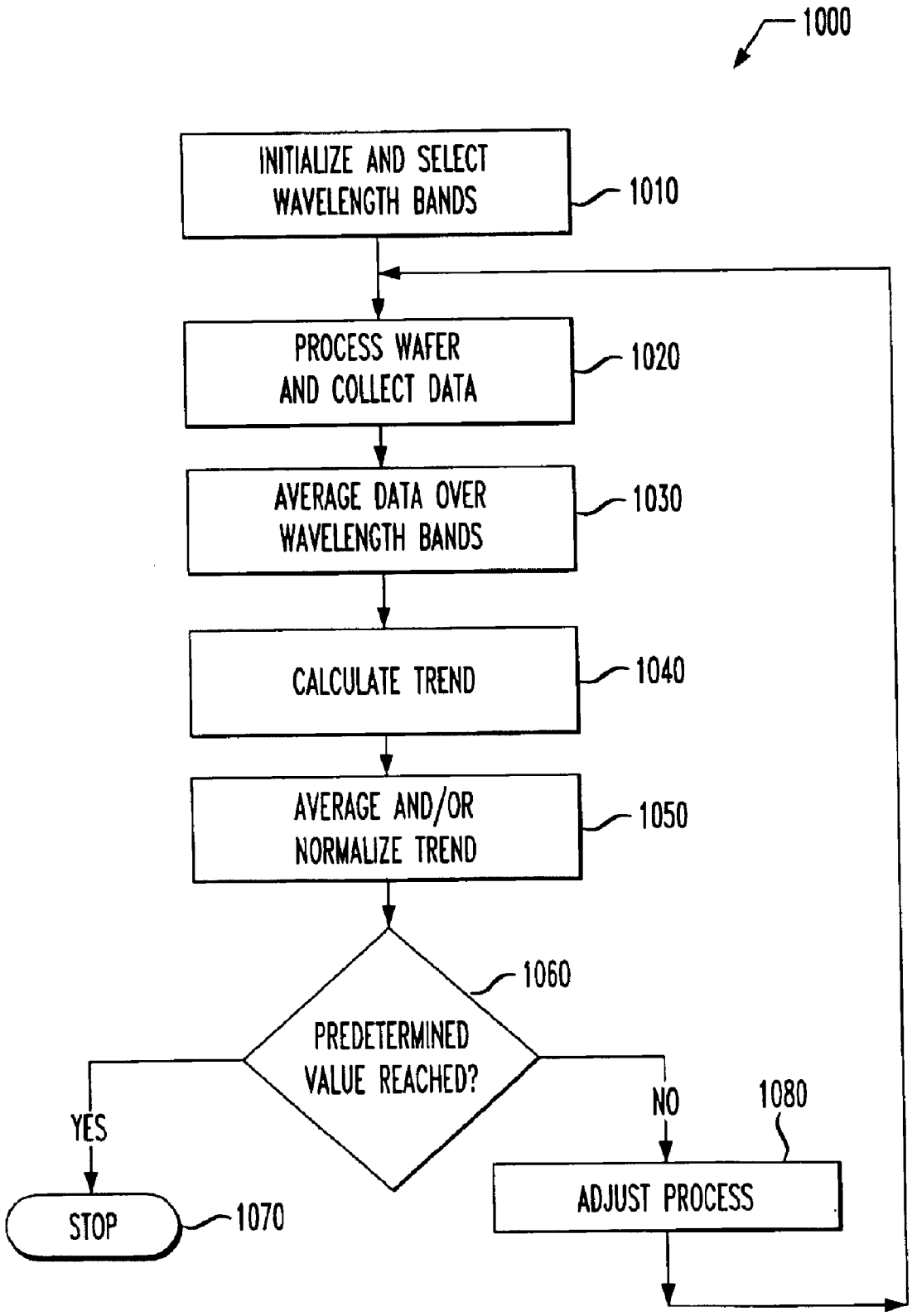
FIG. 10 illustrates a flow diagram of an embodiment of a method of performing a n-band analysis on real-time spectral reflectometry data conducted according to the principles of the present invention.
Figure 12:
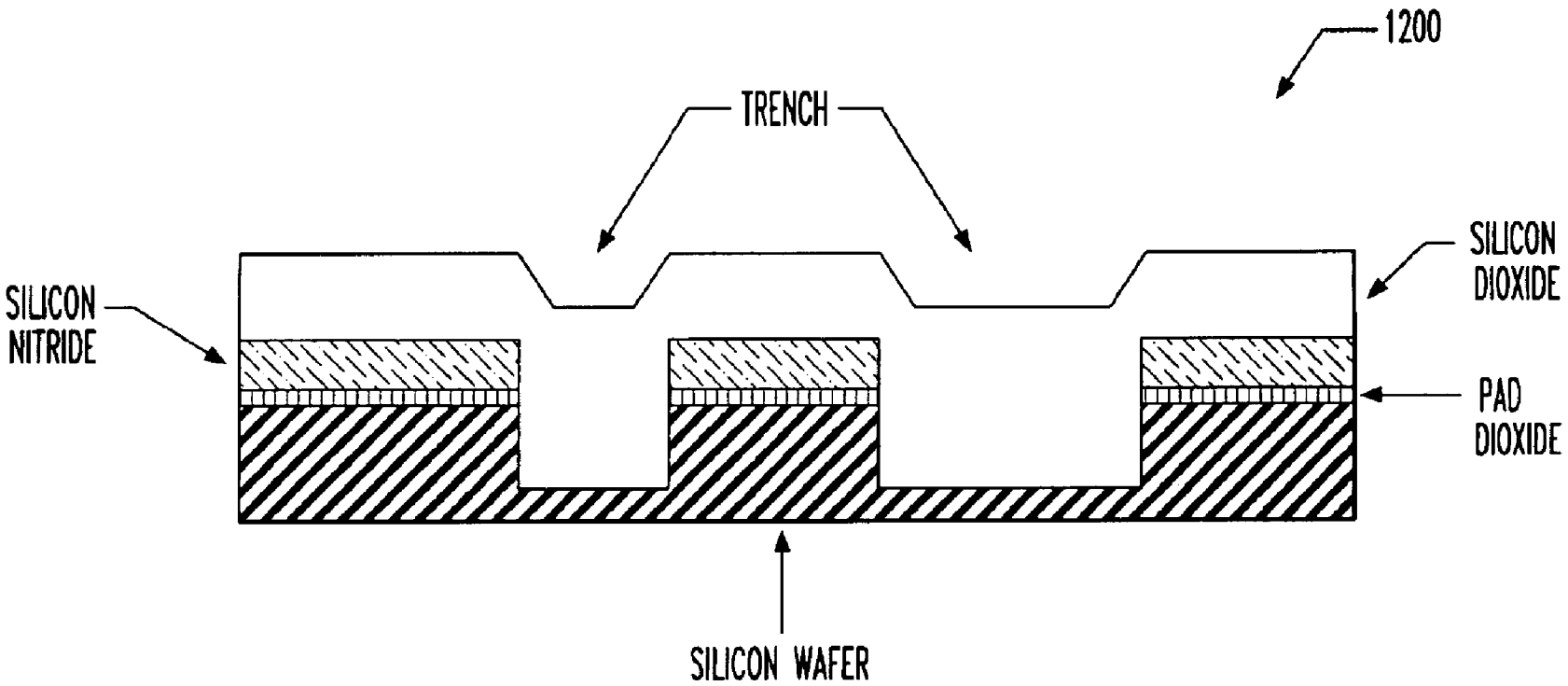
FIG. 12 illustrates an example of a silicon wafer having trenches and employable in shallow trench isolation.

Turning now to FIG. 10, illustrated is a flow diagram of an embodiment of a method of performing a n-band analysis on real-time spectral reflectometry data, generally designated 1000, conducted according to the principles of the present invention. N-band analysis may be used for shallow trench isolation (STI) or other wafer types. An STI type wafer has trenches etched into the silicon substrate and the areas between the trenches are covered with a silicon nitride layer. The silicon nitride layer is covered by and the trenches are filled with silicon dioxide. FIG. 12 illustrates an example of a silicon wafer with trenches. The goal of shallow trench isolation CMP process is to planarize the silicon dioxide and the silicon nitride mask layer. Typically the CMP process would stop once the silicon nitride is exposed or at a given thickness into the silicon nitride layer. The n-band analysis method 1000, in one embodiment, is used in determining a wafer state parameter for shallow trench isolation. In one embodiment, the wafer state parameter may be related to the clearing removal of the oxide over the nitride layer or to thinning of the nitride layer.

The method 1000 first performs initialization and selects the wavelength bands to use for the n-band analysis in a step 1010. The number of bands n may be any number of bands automatically selected by a control subsystem based upon the overall spectral data or user selectable. To permit selection of the wavelength bands, a first test/setup wafer of the same type as the wafers to be processed should be polished. The data so collected is divided into multiple wavelength bands similar to those of FIG. 11A 1120,1130,1140,1150 of equal spectral width. Most commonly the entire spectral range of the recorded spectrum is divided into these narrower spectral bands, although FIG. 11A only shows 4 bands for simplicity. The bands are typically more than 5 mm in width; more commonly 10 nm. These spectral data for each of these bands are then averaged or summed at each time step in the series. Next, each of the new time series (1125, 1135, 1145, 1155) generated from the averaged bands is analyzed for changes in amplitude or slope. FIG. 11B illustrates the time series 1125, 1135, 1145, 1155, that were generated from the bands 1120,1130,1140,1150, illustrating the strongest desired changes. The bands that show the greatest changes in amplitude or slope near or after the desired endpoint time are then selected to be used in the algorithm for further automated wafer processing.

Figure 11A:
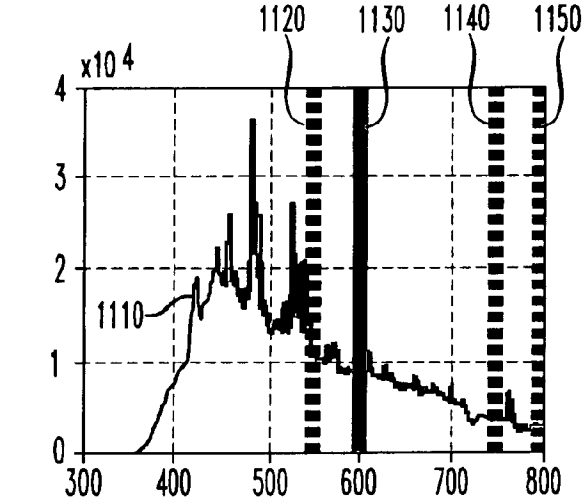
FIGS. 11A–D illustrate an example of the raw spectra and derived real-time spectral reflectometry data analyzed at various stages of the n-band analysis of FIG. 10.
Figure 11B:
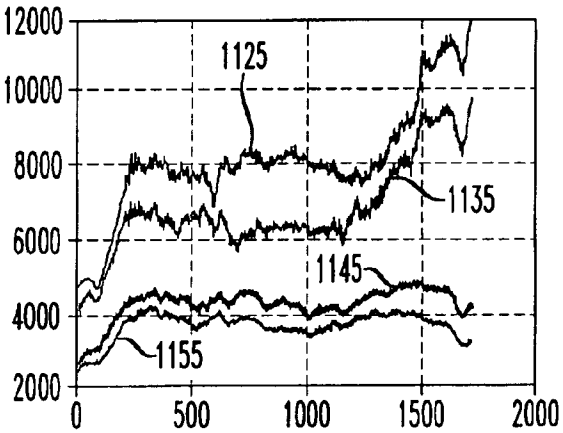

Referring to the signal spectrum from the time series of spectra from a setup wafer in FIG. 11A, four wavelength bands at 550 nm (1120), 600 nm (1130), 750 nm (1140) and 800 nm (1150) will be used to explain the method 1000. In FIG. 11A, the first wavelength band 110 selected for analysis is at 550 nm, which can range from 545 nm to 555 nm. The second wavelength band 1130 is at 600 nm, which can rage from 595 nm to 605 nm. The third wavelength band 1140 is at 750 nm, which can range from 745 nm to 755 nm. The fourth wavelength band 1150 is at 800 nm, which can range from 795 nm to 800 nm. Of course, however, the present invention is not limited to using only four wavelength bands or the exact wavelengths selected. Other embodiments of the present invention may use any number of wavelength bands at any wavelength.

The method 1000 then processes the wafer and collects data for each of the selected wavelength bands in a step 1020. An example of the real-time spectral reflectometry data collected for the four wavelength bands is illustrated in FIG. 11A and in reduced form in FIG. 11B. It has been predetermined by the wavelength bands selected that the 550 nm wavelength band 1125 ($\Delta\lambda 1$) and the 600 nm wavelength band 1135 ($\Delta\lambda 2$) have upward transitions at or near a predetermined value of a wafer state parameter. Also, the 750 nm wavelength band 1145 ($\Delta\lambda 3$) and the 800 nm wavelength band 1155 ($\Delta\lambda 4$) have downward transitions at or near the predetermined value of a wafer state parameter. In the illustrated embodiment, the predetermined value of a wafer state parameter may be the point at which the silicon nitride layer is exposed or a given thickness of material has been removed. Of course, however, other predetermined values of wafer state parameters are within the scope of the present invention.

Figure 11C:
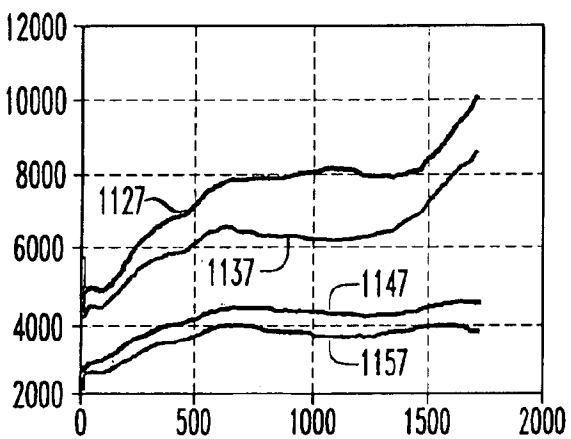
Figure 11D:
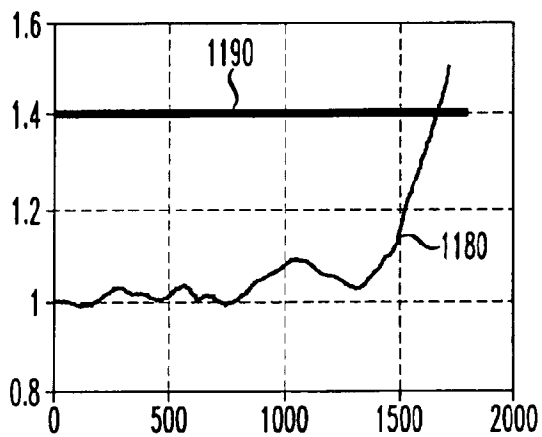

Next, the method 1000 individually averages the real-time spectral reflectometry data over the selected wavelength bands (e.g., 1125, 1135, 1145, 1155 of FIG. 11B) in a step 1030. In this example the method 1000 would individually average the data over the four bands $\Delta\lambda 1$, $\Delta\lambda 2$, $\Delta\lambda 3$, $\Delta\lambda 4$. In another embodiment, the method 1000 may sum the real-time spectral reflectometry data for the selected wavelength bands. The method 1000 then calculates a trend in a step 1040. In one embodiment, the trend may be calculated by $(\Delta\lambda 1+\Delta\lambda 2)/(\Delta\lambda 3+\Delta\lambda 4)$. In the illustrated embodiment, the wavelength bands $\Delta\lambda 1$ and $\Delta\lambda 2$ have upward transitions at or near the predetermined value of a wafer state parameter, and the wavelength bands $\Delta\lambda 3$ and $\Delta\lambda 4$ have downward transitions at or near the predetermined value of a wafer state parameter. Additionally, the method 100 may smooth the time series data into trends with less noise as illustrated in FIG. 11C, trends 1127, 1137, 1147 and 1157.

The method 1000 then averages and/or normalizes the trend in a step 1050. In one embodiment, the average trend is a moving average or an exponential filter. Normalization of the trend is by self-normalization. Self-normalization is defined as the division by the value of the trend at a user selected time after the start of the wafer processing. See FIG. 11D for an exemplary analysis trend for the n-band analysis that has been normalized. Next, the method 1000 determines if a predetermined value of a wafer state parameter has been reached in a decisional step 1060. For this example, the predetermined value of a wafer state parameter is the end-point 1190 of the shallow trench isolation CMP process. If the predetermined value of a wafer state parameter has been reached, the method 1000 stops processing in a step 1070. In a related embodiment, the method 1000 may cause the CMP process to stop.

If the predetermined value of a wafer state parameter has not been reached, the method 1000 may cause the process to be adjusted in a step 1080. In one embodiment, the control subsystem 250 of FIG. 2 may adjust processing parameters or cause physical devices to be adjusted in order to optimally process the wafer. Next, the method 1000 returns to process the wafer and collect more data in the step 1020. Other embodiments of the present invention may have additional or fewer steps than described above.

Figure 13:
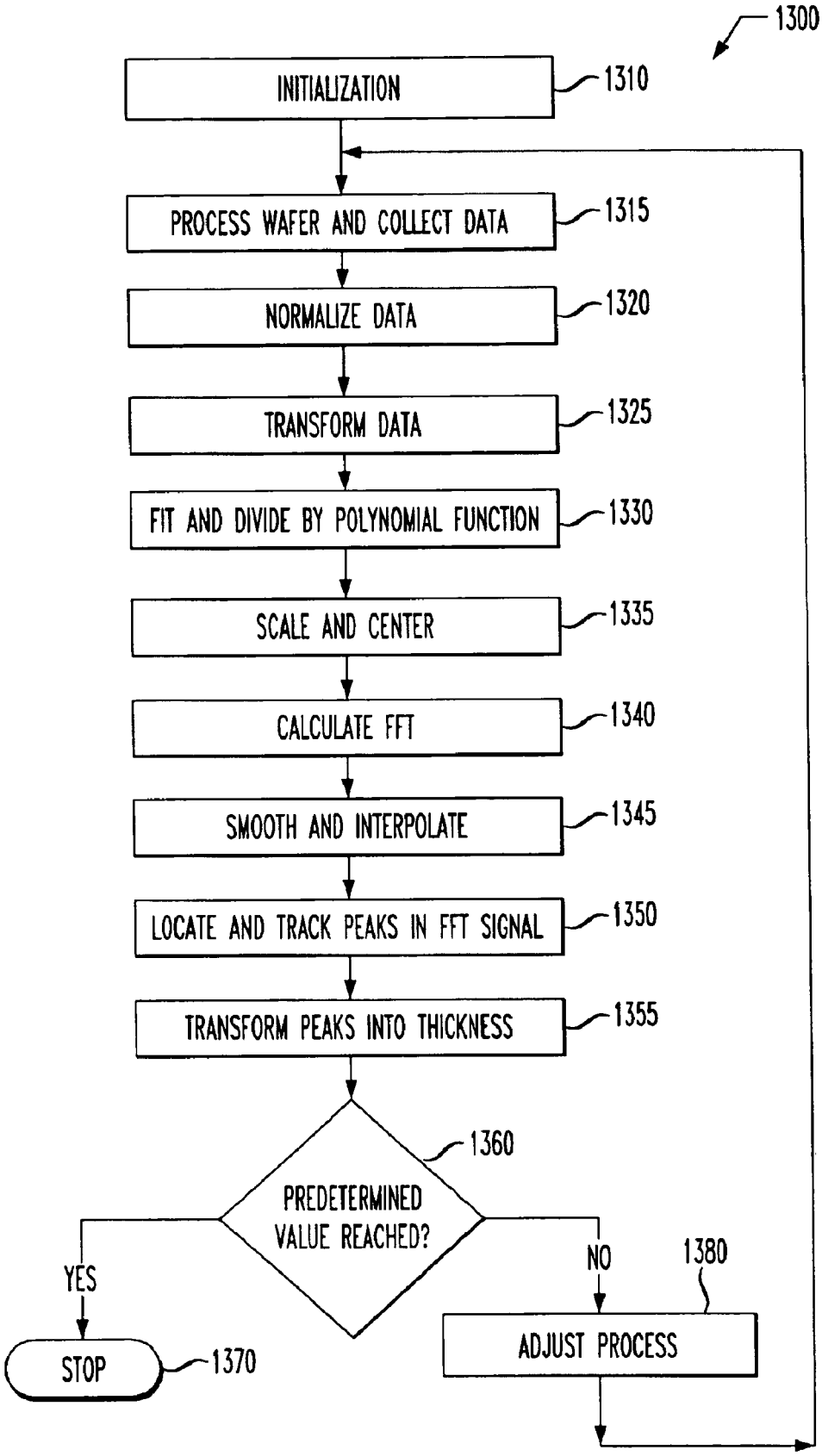
FIG. 13 illustrates a flow diagram of an embodiment of a method of performing a transform analysis on real-time spectral reflectometry data conducted according to the principles of the present invention.
Figure 14:
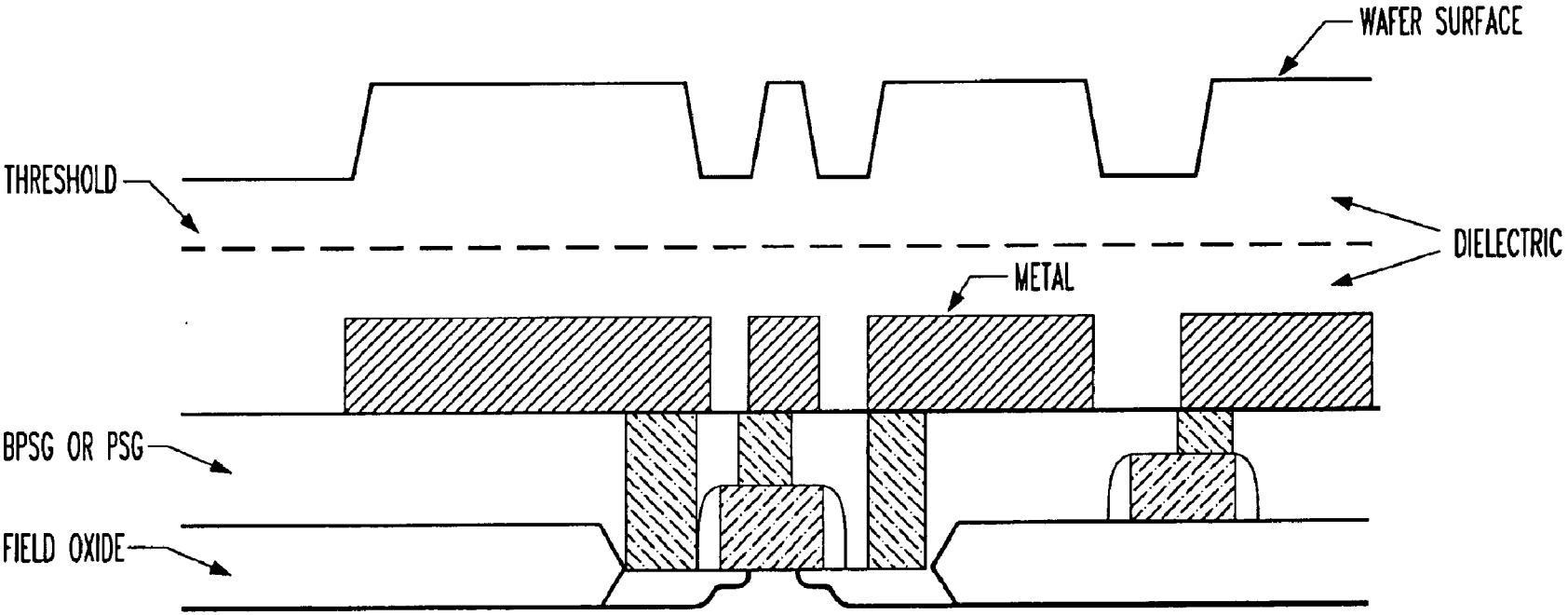
FIG. 14 illustrates an example of a wafer having an interlayer dielectric deposited over the current features of the wafer.

Turning now to FIG. 13, illustrated is a flow diagram of an embodiment of a method of performing a transform analysis on real-time spectral reflectometry data, generally designated 1300, conducted according to the principles of the present invention. Typically, transform analysis may be used for interlayer dielectric or other semitransparent types of films. For example, FIG. 14 illustrates a silicon wafer with a field oxide layer, metal vias within a borophosphosilicate glass (BPSG) or phosphosilicate glass (PSG) layer, and metal traces. The wafer also has a dielectric, such as silicon dioxide, deposited over the current features of the wafer resulting in a rough surface (non-planar). Typically, the goal for the CMP process for interlayer dielectric is to planarize the dielectric to a predetermined thickness or to a relative thickness of the dielectric above the topmost metal layer. FIG. 14 illustrates an example threshold point for planarization of the dielectric. The transform analysis method 1300, in one embodiment, is used in determining a wafer state parameter for interlayer dielectric. Wafer state parameters may include a reflectance or a thickness. Of course, however, the present invention is not limited to these wafer state parameters.

Figure 15A:
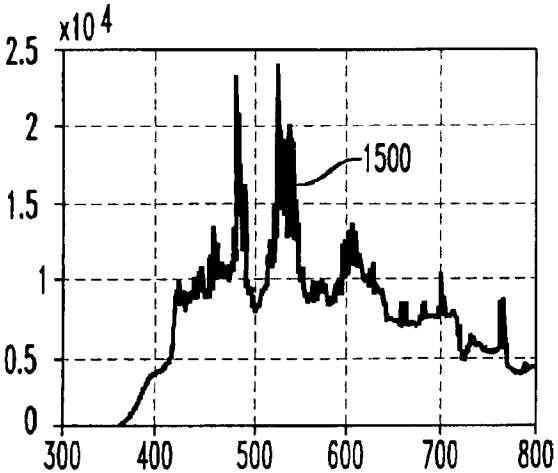
FIGS. 15A–D illustrate an example of the raw spectra and derived real-time spectral reflectometry data analyzed at various stages of the FFT type transform analysis of FIG. 13.
Figure 15B:
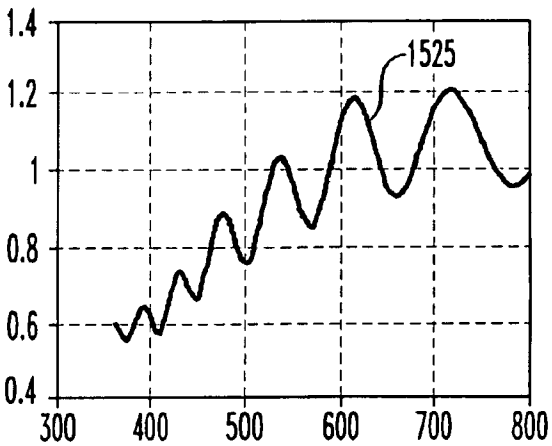

The method 1300 first performs initialization in a step 1310. After initialization, the method 1300 processes the wafer and collects reflectometry data in a step 1315. For example, see the spectra 1500 of FIG. 15A. In one embodiment, the collection includes employing a plurality of optical probes and a spectrograph to obtain real-time reflectometry data of the wafer being processed. Next, the method 1300 normalizes the collected data with previously collected normalization data (Norm(λ)) in a step 1320. The normalization data Norm(λ), in one embodiment, is the data obtained from the normalization method of FIG. 7. The collected data may be normalized as follows:

$$R_{norm}(\lambda) = \frac{R(\lambda) * R_{Silicon}(\lambda)}{\mathrm{Norm}(\lambda)}$$

where R(λ) is an alternative mathematical name for the raw spectral data of the currently processing wafer, and $R_{silicon}(\lambda)$ is the theoretical reflectance of a bare silicon wafer. This mathematical expression assumes that the normalization wafer was a bare silicon wafer. If the normalization data was collected from a different type of wafer, $R_{silicon}$ may be replaced with the theoretical expression for the wafer type used. Trend 1525 of FIG. 15B is an example of the normalized data.

For further discussion of the method of FIG. 13 and associated FIGS. 15A–D and 16A–B, it is assumed that the transform used is a Fourier transform commonly implemented as a "fast Fourier transform" (FFT). Alternatively other mathematical transforms may be employed to transform the data. These types of transforms include Laplace transforms, Z transforms, Legendre transforms, Gabor transforms, and wavelet transforms. Discussion and summary of these and other transforms is noted in "Numerical Recipes in C, the Art of Scientific Computing," by William H. Press et al., Cambridge University press ($2^{nd}$ ed. 1992), which is hereby incorporated by reference. The goal of the transform is to mathematically convert or project the reflectance spectra into a new mathematical form or basis in which one or more wafer state parameters may be easily extracted. The mathematical basis may be selected on theoretical or phenomenological products. This is desired since the reflection spectra of patterned semiconductor wafers is often very complex and direct theoretical modeling often intractable. The FFT transform is often applied since this results in the mathematical functions and values that are easily understood and interpreted to determine desired wafer state parameters such as film thickness. Other transforms such as a Gaussian wavelet transform seeks to decompose the spectra into an easily interpreted basis of the Gaussian function. This function is defined by G(x)=B+A*Exp(−(x−xo)/2s)^2); wherein B is an offset, A an amplitude, xo is a center of the function, and s is the width of the function. These parameters can then be correlated to the wafer state parameters to control the process.

Next, the method 1300 performs a first transform by converting the normalized data $R_{norm}(\lambda)$ into a function of $R_{norm}(1/\lambda)$ or $R_{norm}(n(\lambda)/\lambda)$ in a step 1325. (See FIG. 15C, trend 1550). This conversion seeks to convert the spectral data into a function that is periodic with respect to the function of 1/λ. This functional form is a preferred basis for the analysis of dielectric films due to the theoretical formulation of the Frensel reflection equations. For additional background information on theoretical modeling of reflections from film stacks, see "Ellipsometry and Polarized Light," by R. M. A. Azzam and N. M. Basara, Elsevier Science (1987), which is hereby incorporated by reference in its entirety. A review of the theoretical forms of the reflections often provides details for the selection of the best transforms to be selected in the analysis of the data. The procedure for converting the spectral data [data(i,:)] into a function that is periodic with respect to the function of 1/λ [ExpR] may be performed by Matlab code illustrated in Table 1.

TABLE 1

```
wls=250; wle=800;
wl=wls:0.5:wle;
wlindex = (wl−200)*2 + 1;
indexfilm = ones(l,length(wl));
wnumarray = (indexfilm ./ wl);
Nwlpoints = length(wl);
NumpointsI = 1024;
dwnum=(wnumarray(end)−wnumarray(1))/NumpointsI;
iwnum=wnumarray(1)+0.5*dwnum:dwnum:wnumarray(end);
ExpR = interp1(wnumarray,data(i,:),iwnum);
```

Figure 15C:
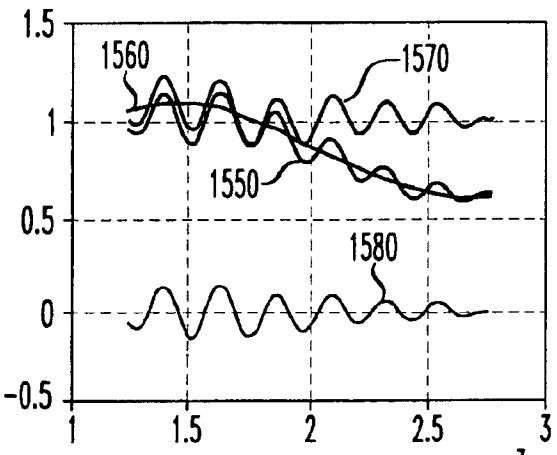
Figure 15D:
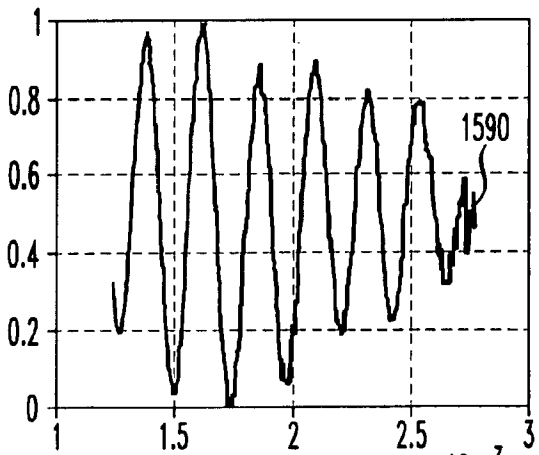

The method 1300 then fits the converted and normalized data $R_{norm}$ into a low order polynomial function, typically cubic in order, or less, in a step 1330. (See FIG. 15C trend 1560). This polynomial function may be replaced by other functions such as exponential, exp(x), or power law functions, x^y. Function 1/(x^4) is typical of attenuation due to scattering in slurry. The method 1300, in the step 1330, also divides or subtracts the result of step 1325 by that polynomial. For example, trend 1570 of FIG. 15C is the result of trend 1550 divided by trend 1560, and trend 1580 is the result of trend 1560 subtracted from trend 1550. This removes the wavelength-dependent effects of scattering and attenuation caused by the slurry and other effects, such as the transmission of the probe window. Trends 1570 and 1580 of FIG. 15C illustrates that this procedure recovers some or all of the decreased amplitude of the oscillation seen at the end of the trend 1550.

Next, the method 1300 then scales and mean centers fitted data $R_{norm}$ in a step 1335. (See FIG. 15D trend 1590). In one embodiment, the method 1300 means centers $R_{norm}$ and scales $R_{norm}$ by dividing it by its standard deviation (StDev). For example:

$$R_{norm} = \frac{(R_{norm} - \text{Mean}(R_{norm}))}{STDEV(R_{norm})}$$

Alternatively, the method 1300 scales and centers by:

$$R_{norm} = \frac{(R_{norm} - \text{Min}(R_{norm}))}{(\text{Max}(R_{norm}) - \text{Min}(R_{norm}))}$$

This reduces the amplitude variation of the signal. One of the goals is to isolate only the oscillation components of the signal.

Next, the method 1300 calculates a Fast Fourier Transform (FFT) or a Power Spectral Density (PSD) on $R_{norm}$ in a step 1340. The application of an FFT or PSD calculation to data is well known and is detailed in "Numerical Recipes in C, the Art of Scientific Computing," by William H. Press et al., Cambridge University Press ($2^{nd}$ ed. 1992), which is hereby incorporated by reference.

Next, the method 1300 smoothes and interpolates the resultant data that is the output of the FFT transform in a step 1345. (See FIG. 16A trend 1610). This process lessens the digitization of the data that is caused by application of the FFT process. The abscissa values of the FFT data are now proportional to the thickness of the film layer. The ordinate values are proportional to the amount of that film present on the wafer. The method 1300 also calculates first and second derivatives of the FFT data. (See FIG. 16A trend 1630 and trend 1640, respectively). The smoothing and derivative may be obtained by applying a Savitski-Golay smoothing function. Spline functions may also be used to smooth and calculate derivatives. For more information concerning the application of these functions to data, see "Numerical Recipes" listed previously.

The method 1300 then locates and tracts each peak in the FFT signal in a step 1350. In one embodiment, the peaks in the FFT signal are located by using a differencing filter acting upon the first derivative of the FFT signal in combination with the evaluation of the signal of the second derivative at the location of the peak. The possible peak locations are determined via the zero-crossing of the first derivative of the FFT signal. If the second derivative is negative at that point, then there is a peak. See FIG. 16A for an exemplary transform analysis trend illustrating first (1630) and second (1640) derivatives of the FFT signal. Also in FIG. 16A, the intersections of lines 1620 and 1622 with the FFT transform trend 1610 illustrate an example of where two peaks occurred. These peaks are the identified maxima above a threshold of 0.25. This also relates to the film thicknesses that are present at 25% or greater in the compound signal. Table 2 illustrates a section of Matlab code that exemplifies the algorithm for finding peaks in the data.

TABLE 2

```
dersmdata = savgol(smdata,5,2,1);
derdersmdata = savgol(dersmdata,5,2,1);
intdata=sign(dersmdata);
t=filter([1 1],1,intdata);
clear zcarray;
ss = find(smdata<=0.25);
t = sign(sign(sign(derdersmdata)+1)+sign(abs(t)));
t(ss) = 1;
t(round(NumpointsInterp):end)=1;
zcarray = find(t==0);
```

Figure 16B:
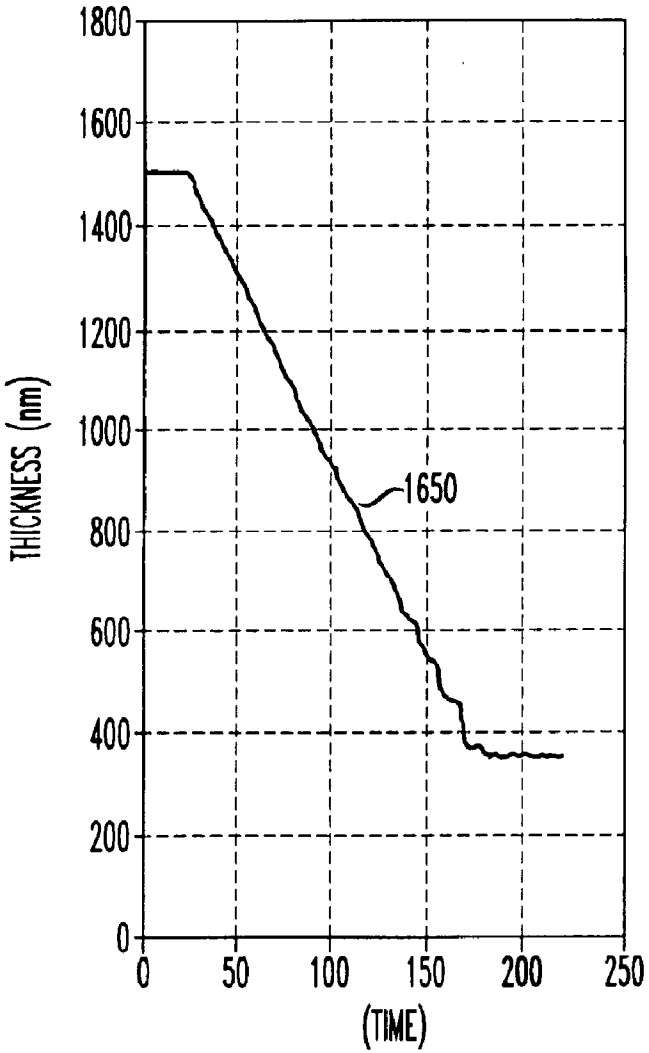
FIGS. 16A and 16B illustrate an example of the further processing of the derived real-time spectral reflectometry data of FIGS. 15A–D, wherein the derivatives of the FFT signal are used to determine a wafer state parameter for the CMP processing of an interlayer dielectric.
Figure 16A:
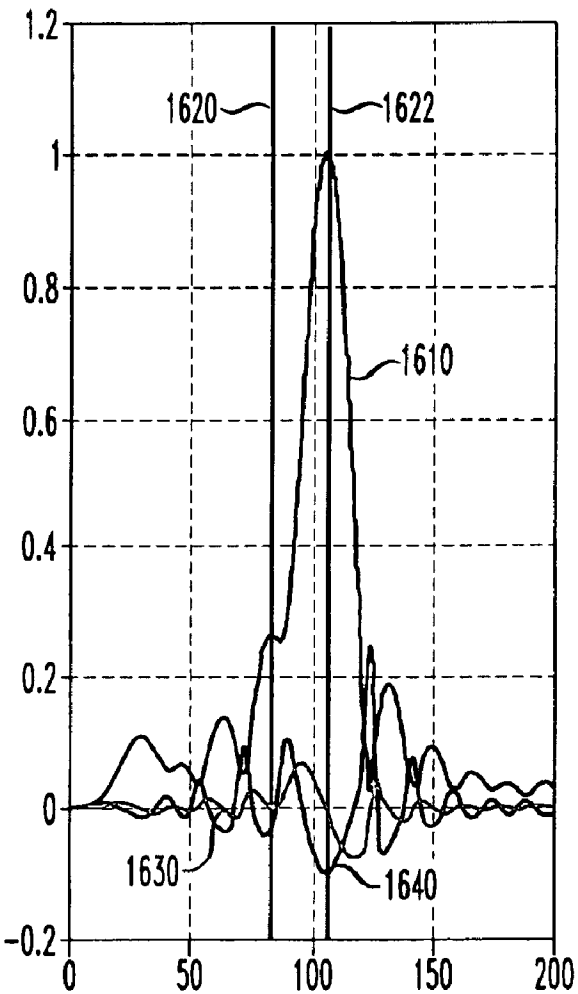

Next, the method 1300 may transform the abscissa of the located peak or peaks into film thicknesses. This is done by applying the proper scaling factors to the abscissa data from the FFT process. These factors include division by the resolution of the data onto which the FFT was applied as well as the number of points to which the FFT was applied. Typically only the largest peak located or a peak within a specific thickness range is then used as the wafer state parameter. See trend 1650 of FIG. 16B, which illustrates an exemplary trend of thickness that is determined by tracking the values of the peak at the intersection of line 1622 and trend 1610. Of course, however, the present invention is not limited to only determining one film thickness as illustrated in FIG. 16B. In other embodiments, the present invention can determine film thicknesses for every peak located or any number thereof.

Next, the method 1300 determines if a predetermined value of a wafer state parameter has been reached in a decisional step 1360. For this example, the predetermined value of the wafer state parameter may be the planarization of the dielectric to a predetermined thickness or to a specific thickness above the topmost metal layer. See also, FIG. 14 for an example predetermined value of the wafer state parameter (threshold point) in the dielectric layer of a wafer. The decision may be calculated by determining if the thickness that corresponds to the located peak or peaks is less than or equal to the predetermined threshold thickness. If the predetermined value of the wafer state parameter has been reached, the method 1300 stops processing in a step 1370. In a related embodiment, the method 1300 may cause the CMP process to stop.

If the predetermined value of the wafer state parameter has not been reached, the method 1300 may cause the process to be adjusted in a step 1380. In one embodiment, the control subsystem 250 of FIG. 2 may adjust processing parameters or cause physical devices to be adjusted in order to optimally process the wafer. Next, the method 1300 returns to process the wafer and collect more data in the step 1315. Other embodiments of the present invention may have additional or fewer steps than described above.

Figure 17:
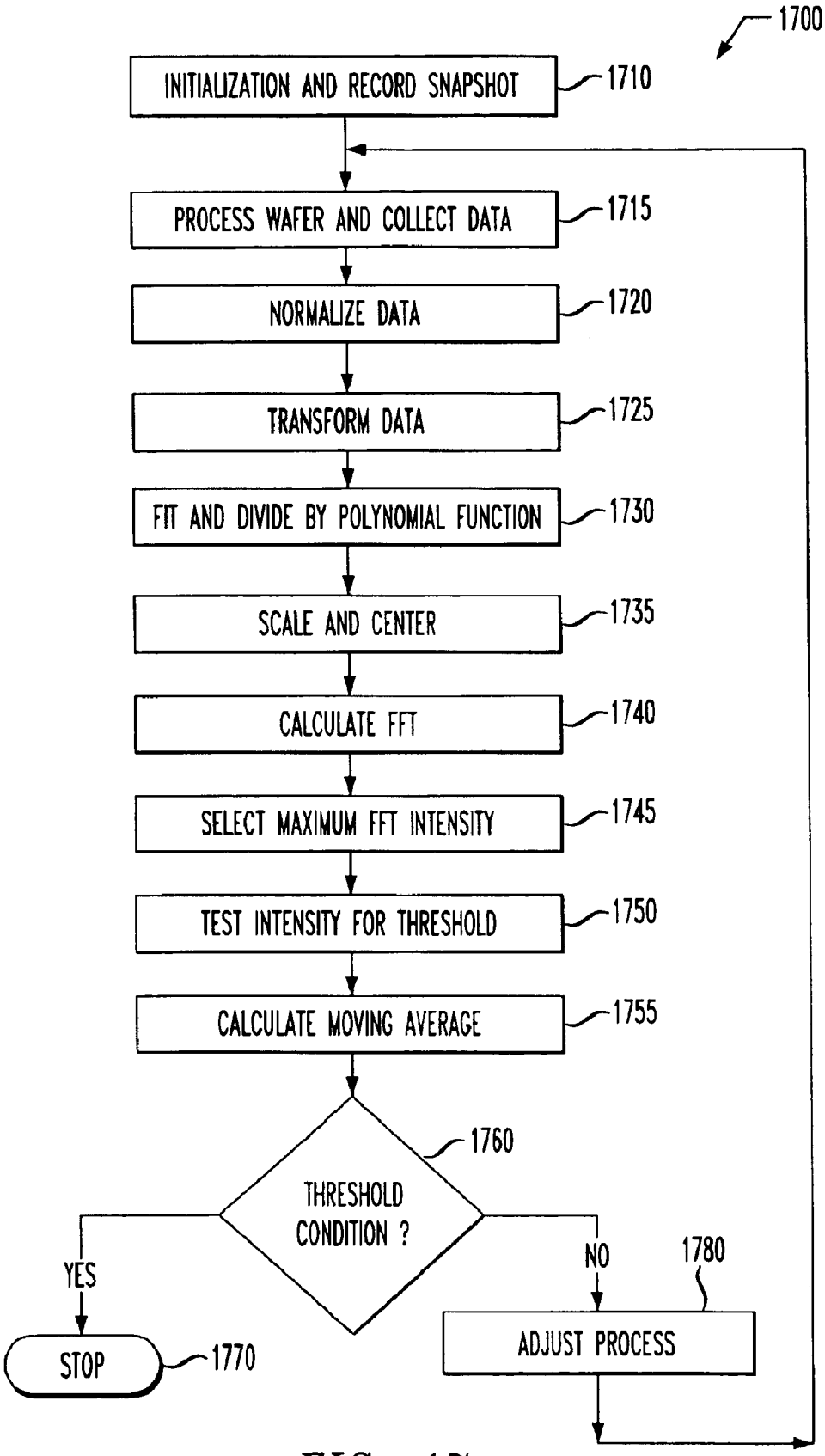
FIG. 17 illustrates a flow diagram of an embodiment of a method of performing a metal breakthrough analysis on real-time spectral reflectometry data conducted according to the principles of the present invention.
Figure 18:
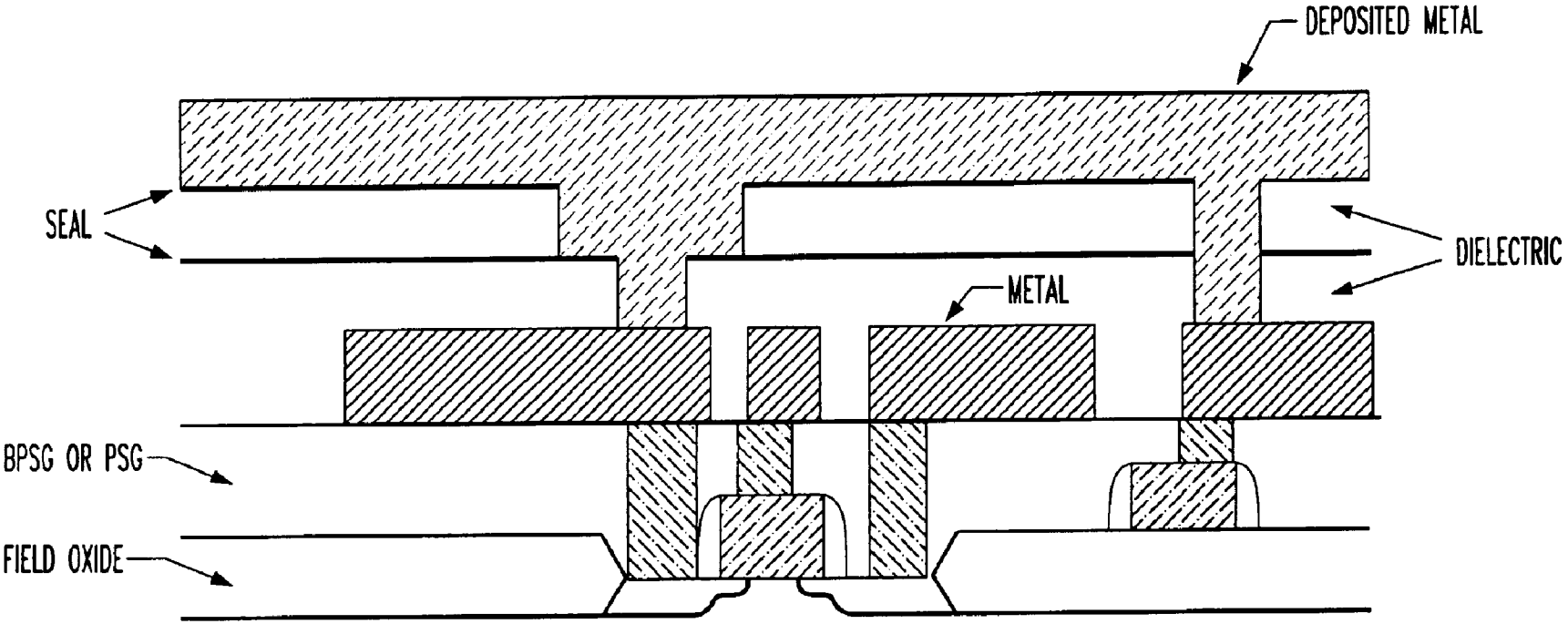
FIG. 18 illustrates an example of a wafer having a metal layer deposited onto the entire top surface of the wafer.

Turning now to FIG. 17, illustrated is a flow diagram of an embodiment of a method of performing a metal breakthrough analysis on real-time spectral reflectometry data, generally designated 1700, conducted according to the principles of the present invention. Typically, metal breakthrough analysis may be used for monitoring the removal of a deposited layer of metal in order to isolate individual wires and vias. FIG. 18 illustrates an example silicon wafer employable by the method 1700 and having a bottom field oxide layer and a second layer having metal vias within a borophosphosilicate glass (BPSG) or phosphosilicate glass (PSG) layer. The wafer also includes a third layer having metal traces and vias within a dielectric, such as silicon dioxide, and a first seal layer. The first seal layer may be a silicon nitride layer. After the first seal layer, the wafer includes another dielectric layer followed by a second seal layer and a final layer of deposited metal. FIG. 18 also illustrates metal structures extending downward from the top layer through intermediate layers to the metal structure in the first dielectric layer. The CMP process would typically remove the top deposited layer of metal of this silicon wafer.

Referring back to FIG. 17, the metal breakthrough analysis detects the frequency transitions in a normalized signal from substantially straight line trends to multiple higher frequency components. The substantially straight line trend occurs when the CMP process is in the early stages of removing the metal layer and the multiple higher frequency components usually occurs when the metal layer is removed leaving the underlying dielectric layer. In one embodiment, the metal breakthrough analysis illustrated by the method 1700 is used in determining a wafer state parameter, such as a transition from straight line tread to multiple higher frequency components. This wafer state parameter is directly correlated to the removal of the bulk metal film above the underlying dielectric film. Also, this wafer state parameter is generally independent of the complications in the reflectance of the wafer that are caused by the deeper underlying layers or metal or dielectric. Of course, however, the present invention is not limited to this wafer state parameter. In addition, the method 1700 is a modified form of the more general transform method noted previously.

Figure 19A:
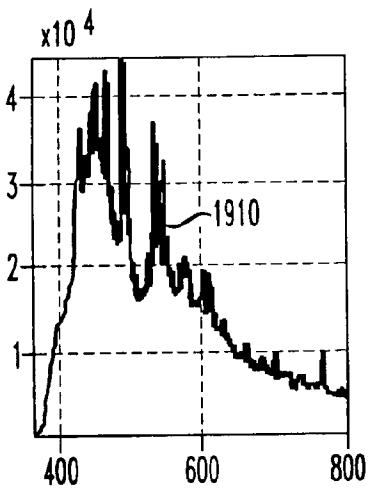
FIGS. 19A–F illustrate an example of the raw spectra and derived real-time spectral reflectometry data analyzed at various stages of the metal breakthrough analysis of FIG. 16.
Figure 19B:
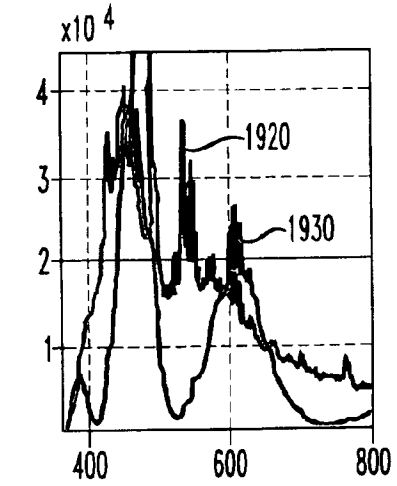
Figure 19C:
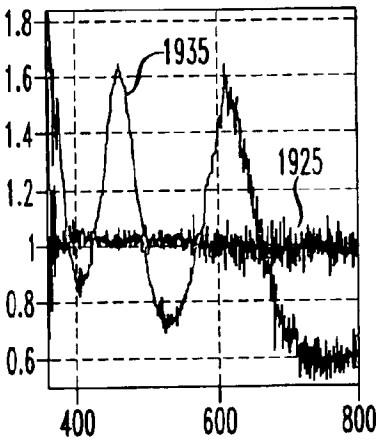

The method 1700 first performs initialization and starts initial processing of the wafer in a step 1710. Also, the method 1700, after a few seconds of processing to allow for stability, records a snapshot of the averaged raw spectra in the step 1710. The snapshot ($R_{snap}(\lambda)$) is used for self-normalization of the raw spectra. See FIGS. 19A trend 1910 for exemplary snapshot spectra. After initialization, the method 1700 processes the wafer and collects data in a step 1715. In one embodiment, the collection includes employing a plurality of optical probes and a spectrograph to obtain real-time reflectometry data of the wafer being processed. Next, the method 1700 normalizes the collected data with previously snapshot data $R_{snap}(\lambda)$ in a step 1720. The collected data may be normalized as follows:

$$R_{norm}(\lambda) = \frac{R(\lambda)}{R_{snap}(\lambda)}$$

where $R(\lambda)$ is an alternative mathematical name for the raw spectral data. Exemplary data prior to normalization are shown by spectrum 1920 and spectrum 1930 in FIG. 19B. The spectrum 1920 is a spectrum recorded early in the CMP process when the metal film remains thick and the underlying dielectric is obscured. It is substantially similar to the snapshot of raw spectra 1910. The spectrum 1930 is a spectrum recorded after some or all of the metal has been removed and the dielectric is exposed. The fringes are evident. Related normalized spectra are shown in FIG. 19C trend 1935 (metal removed) and trend 1925 (metal remaining).

Next, the method 1700 performs a transform by converting the normalized data $R_{norm}(\lambda)$ into a function of $R_{norm}(1/\lambda)$ or $R_{norm}(n(\lambda)/\lambda)$ in a step 1725. This conversion seeks to convert the spectral data into a function that is periodic with respect to the argument $1/\lambda$. This functional form is a preferred basis for the analysis of dielectric films due to the theoretical formulation of the Frensel reflection equations. The procedure for converting the spectral data [(data(i,:)] into a function that is periodic with respect to the function of $1/\lambda$ [ExpR] may be performed by Matlab code illustrated in Table 1 described previously.

The method 1700 then fits the converted and normalized data $R_{norm}$ into a low order polynomial function, typically cubic in order, or less, in a step 1730. This polynomial function may be replaced by other functions such as exponential, exp(x), or power law functions, x^y. Function 1/(x^4) is typical of attenuation due to scattering in slurry. The method 1700, in the step 1730, also divides or subtracts the result of step 1725 by that polynomial. This removes the effect of scattering and attenuation caused by the slurry and other effects, such as the transmission of the probe window. See step 1330 of FIG. 13 for additional discussion on removing the effects of scattering.

The method 1700 may then scale and mean center the fitted data $R_{norm}$ in a step 1735. In one embodiment, the method 1300 mean centers $R_{norm}$ and scales $R_{norm}$ by dividing it by its standard deviation (StDev). For example:

$$R_{norm} = \frac{(R_{norm} - \text{Mean}(R_{norm}))}{STDEV(R_{norm})}$$

Alternatively, the method 1700 scales and centers by:

$$R_{norm} = \frac{(R_{norm} - \text{Min}(R_{norm}))}{(\text{Max}(R_{norm}) - \text{Min}(R_{norm}))}$$

This reduces the amplitude variation of the signal. One of the goals is to isolate only the oscillating components of the signal.

Figure 19D:
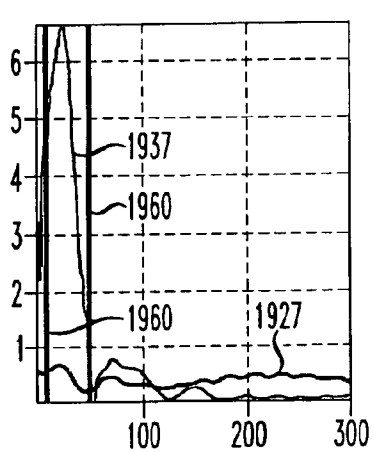

Next, the method 1700 calculates a FFT or a Power Spectral Density (PSD) on $R_{norm}$ in a step 1740. As discussed previously, the application of an FFT or PSD calculation to data is well known. An exemplary output of step 1740 is shown in FIG. 19D. Therein, signal 1927 shows the FFT signal resulting from the FFT of the input signal 1925 indicative of the metal remaining on the wafer. Signal 1937 is the output from the FFT of signal 1935, which indicates that the metal has been removed. Observation of the peak in the FFT signals 1927 and 1937 within the preselected bounds 1960 show that the peak amplitude is much greater when the metal is removed. The amplitude of this peak forms the basis of the wafer state parameter; namely the clearing of the metal film from the wafer.

Next, the method 1700 selects a maximum FFT intensity in a step 1745. The maximum FFT intensity may be selected from a preselected range of FFT frequencies. These frequencies are directly related to the clearing of the metal layer over the underlying dielectric. The preselected range of frequencies is selected by running a first setup wafer and processing the data and observing where the amplitude of the frequencies change most strongly as the wafer approaches the desired endpoint.

Figure 19E:
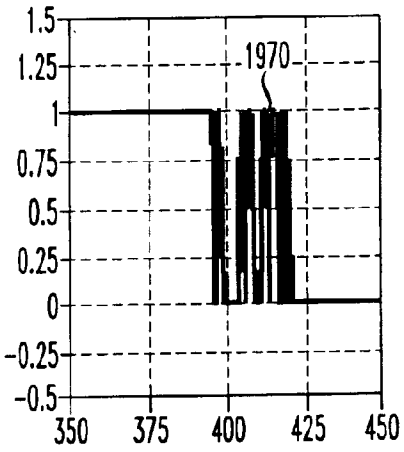

The method 1700 then tests the selected maximum FFT intensity for an intensity threshold condition in a step 1750. The threshold condition is a preselected value for the intensity that defines a demarcation for the two possible states of the wafer. The first state being uncleared (the metal is still thick and the normalized spectra remain substantially straight). The second state is that the metal is mostly removed (the normalizd spectra contain oscillations denoting the detection of the underlying dielectric). This threshold is selected similarly to the method used for determining the range from which to select the peak. The method 1700 then sets the output of the test to zero if the selected maximum intensity is greater than the intensity threshold condition and sets the output to one if the selected maximum intensity is less than the intensity threshold condition. This converts the data analysis into a binary decision of "1" meaning that the wafer remains covered with metal or "0" if clear of the metal. FIG. 19E shows the trend output 1970 for the step 1750 for part of a CMP process.

Figure 19F:
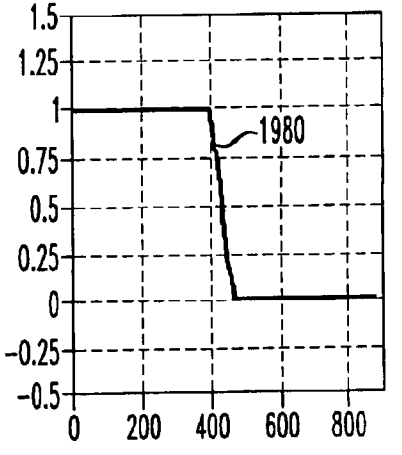

Next, the method 1700 calculates a moving time average of the results obtained in the previous step in a step 1755. The moving average of signal 1970 is illustrated in FIG. 19F trend 1980. Calculation of a moving time average is well known to one skilled in the art.

The method 1700 then determines if a threshold condition (predetermined value of a wafer state parameter) has been reached in a decisional step 1760. For example, the threshold is a value below which the trend 1980 should surpass. For a simple endpoint of the removal of the metal from the wafer, the trend 1980 goes from one (fully covered with metal) to zero (fully cleared of metal). The threshold is then set at or near a value of zero. When trend 1980 surpasses this value, the method 1700 determines in the decisional step 1760 that the process is finished and the method 1700 stops processing in a step 1770.

If the threshold condition has not been reached, the method 1700 may cause the process to be adjusted in a step 1780. In one embodiment, the control subsystem 250 of FIG. 2 may adjust processing parameters or cause physical devices to be adjusted in order to optimally process the wafer. Next, the method 1700 returns to process the wafer and collect more data in the step 1715. Other embodiments of the present invention may have additional or fewer steps than described above.

Figure 20:
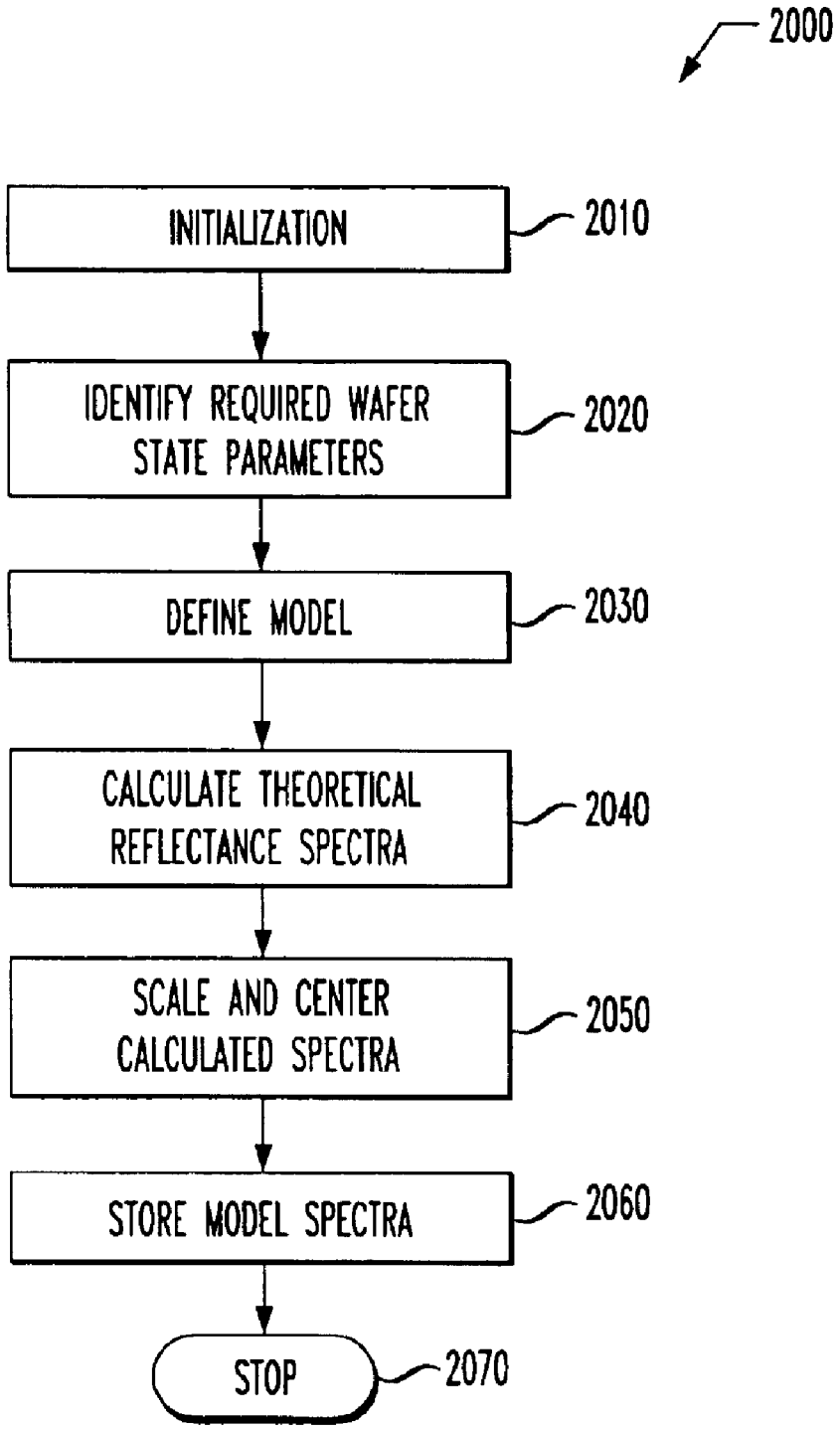
FIG. 20 illustrates a flow diagram of an embodiment of a method of determining a model for use with a model analysis conducted according to the principles of the present invention.

Turning now to FIG. 20, illustrated is a flow diagram of an embodiment of a method of generating a model for use with a model analysis, generally designated 2000, conducted according to the principles of the present invention. The model generated by the method 2000, in one embodiment, is used as a theoretical optical model in a method of performing a model analysis on realtime spectral reflectometry data described in FIG. 24. The method 2000 first performs initialization in a step 2010.

Figure 21:
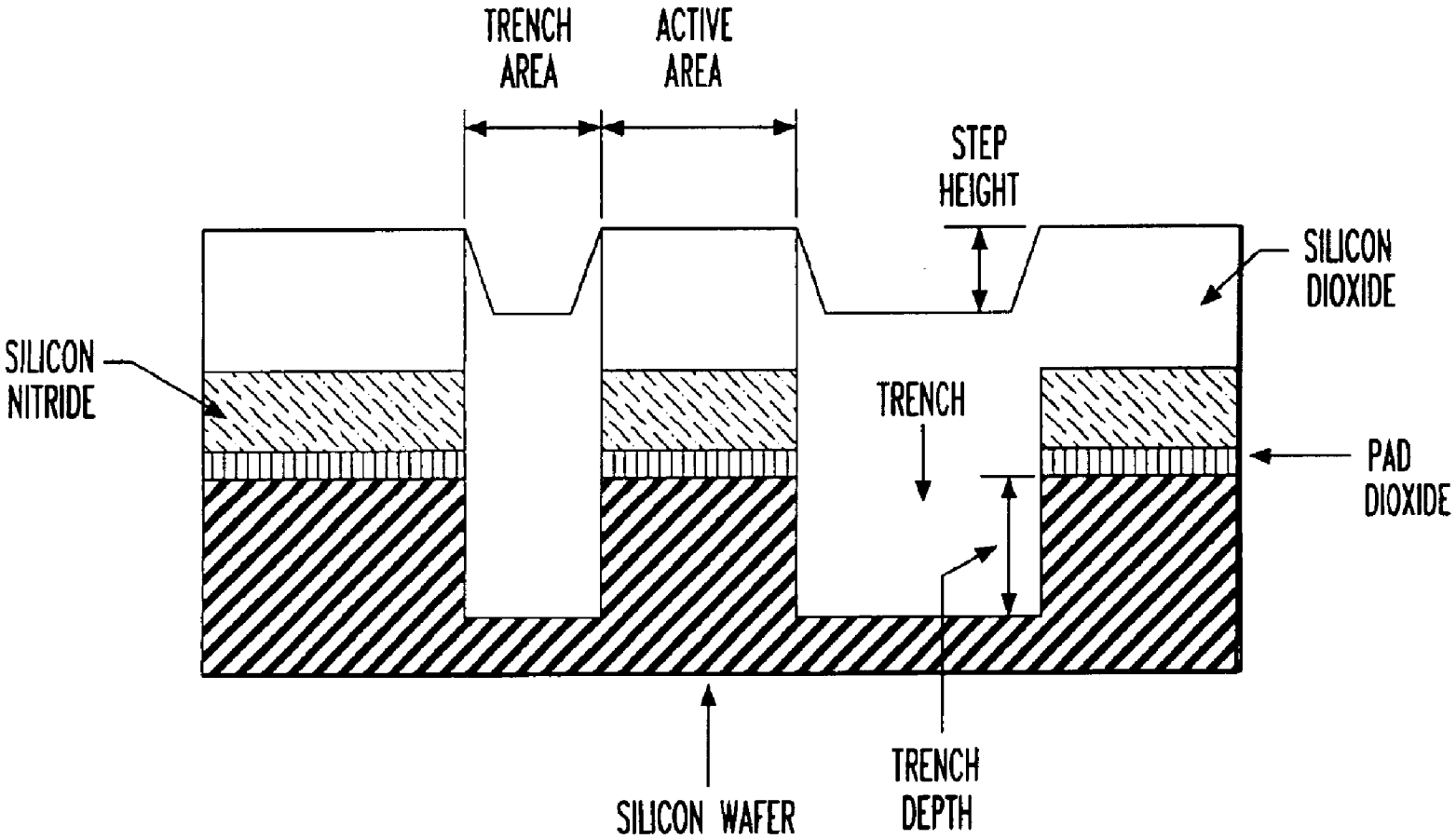
FIG. 21 illustrates an exemplary wafer and associated wafer state parameters employable in a chemical mechanical process according to the principles of the present invention.
Figure 22:
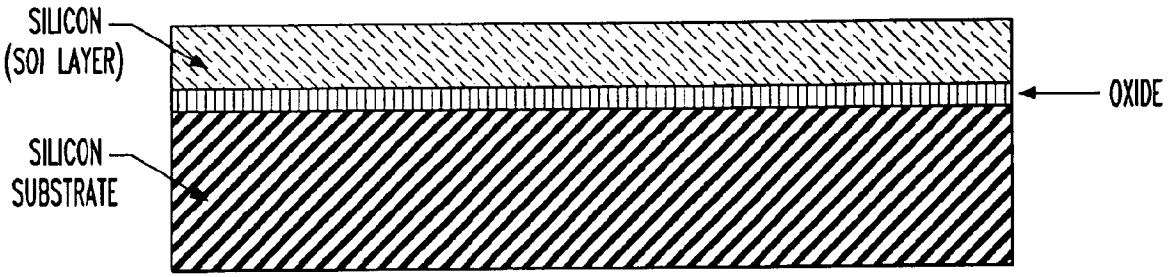
FIG. 22 illustrates an exemplary silicon-on-insulator type wafer employable in a method of the present invention.

After initialization, the method 2000 then identifies the wafer state parameters required to develop the model of the structure to be monitored during the chemical mechanical process in a step 2020. For example, FIG. 21 illustrates an exemplary wafer and associated wafer state parameters that are employable in a chemical mechanical process, such as shallow trench isolation, and employable by the present invention. The wafer state parameters that may be monitored by an embodiment of the present invention include a trench depth, a step height of the silicon dioxide, an area of the trench or active region of the semiconductor device, thicknesses of the silicon dioxide top and pad layers, and a thickness of the silicon nitride layer. For purposes of discussion only, the method 2000 and the method of FIG. 24 will described employing a simpler type of wafer called a silicon-on-insulator (SOI) wafer. FIG. 22 illustrates an exemplary SOI wafer having a structure that consists of three lamellae: a silicon substrate, a buried silicon dioxide layer on top of the silicon substrate, and a top silicon SOI layer. The wafer state parameters for this type of wafer are typically a thickness of the top silicon SOI layer and a thickness of the underlying buried oxide (BOX) layer. However, the thickness of the BOX layer is usually a known value or within a known range. For this example, the thickness of the BOX layer will be considered fixed and will have no substantial effect on the monitoring of the CMP process. Thus, the thickness of the SOI layer will be monitored and used as the wafer state parameter to adjust or stop the polishing process. See FIG. 24 for more discussion on applying the model analysis method on real-time data.

Figure 23:
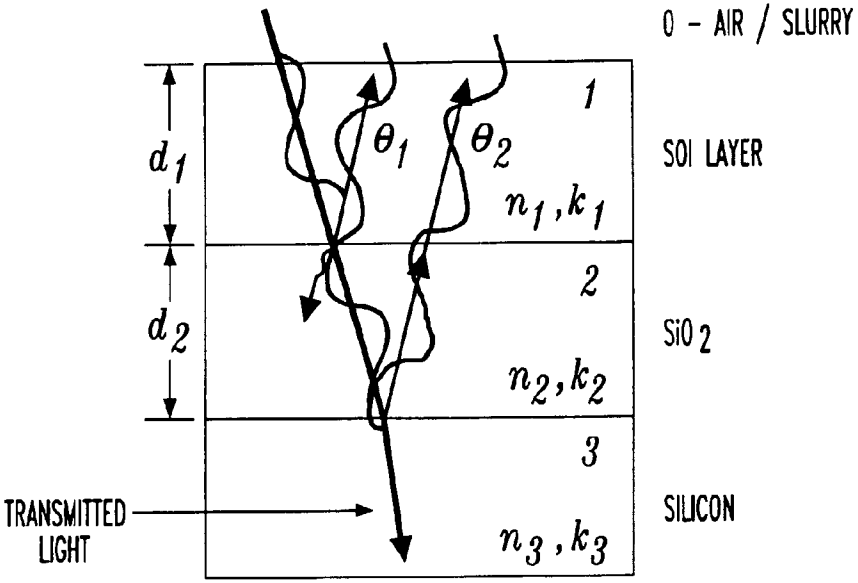
FIG. 23 illustrated is exemplary reflectances of a spot of light transmitted into a silicon-on-insulator type wafer of FIG. 22.

After identifying the required wafer state parameters, the method 2000 then defines the model in a step 2030. In one embodiment, the method 2000 employs the identified wafer state parameters and other necessary information, such as optical indices of the materials that comprise the type of wafer to be modeled, to define the model. In constructing an optical model for the SOI type wafer of FIG. 22, a simple optical model may be created since it is not required to compute a spectrum that will match the observed spectra precisely. Also, in constructing the optical model it is preferable to make as few assumptions about the structure as possible. For this example, it is assumed only that the reflection from the wafer is proportional to the coherent sum of the reflections from the lamellar interfaces. FIG. 23 illustrates exemplary reflectances of a spot of light transmitted into the SOI type wafer of FIG. 22. FIG. 23 also illustrates that the spot of light transmitted into the SOI type wafer can have reflectances from each layer of the wafer.

The reflectivity of the surface of the SOI type wafer may be calculated as follows for any one wavelength:

$$R = \left| \frac{(r_{01} + r_{12}e^{-i2\beta_1}) + (r_{01}r_{12} + r_{01}e^{-i2\beta_1})r_{23}e^{-i2\beta_2}}{(1 + r_{01}r_{12}e^{-i2\beta_1}) + (r_{12} + r_{01}e^{-i2\beta_1})r_{23}e^{-i2\beta_2}} \right|^2$$

where $r_{01}$, $r_{12}$ and $r_{23}$ are the reflection coefficients of the three interface regions, respectively. Also, $\beta_1$ is the phase thickness of the SOI layer, and $\beta_2$ is the phase thickness of the BOX layer. The reflection coefficients can be computed from Fresnel's equation:

$$r_{nm} = \frac{N_m - N_n}{N_m + N_n}$$

where $N_x = n_x - ik_x$. Similarly, the phase thickness is given by:

$$\beta_x = \frac{2\pi d_x}{\lambda} N_x(\lambda)$$

using the real and imaginary parts n and k of the refractive index of the material (for layer index 0=superstate [water], 1=SOI layer [silicon], 2=BOX layer [silicon dioxide], 3=substrate [silicon]).

The reflection coefficients can be computed using the standard formalism for calculating the reflection coefficient of a multilayer stack. For additional discussion on the methodologies for defining the reflectance and transmission properties of thin film stacks and the above calculations, see "Ellipsometry and Polarized Light," by R. M. A. Azzam and N. M. Basara, Elsevier Science pp. 332–40(1987), which is hereby incorporated by reference. As it stands, the optical model for the SOI wafer contains two unknown or variable wafer state parameters $d_1$ and $d_2$, (the thickness of the SOI and BOX layers) assuming the optical constants of each of the constituent materials are known. Of course, however, the present invention is not limited to calculating an optical model only for a SOI type wafer. In other embodiments, an optical model can be created for any type of wafer capable of being analyzed by a model analysis method.

Next, the method 2000 calculates theoretical reflectance spectra in a step 2040. In one embodiment, the reflectance values R(λ, wafer state parameter 1, wafer state parameter 2, . . . , wafer state parameter n) for the optical model are evaluated at predetermined values of wavelength throughout the wavelength region of interest or observation. A common wavelength region of observation may be from 200 to 800 nm. The predetermined wavelengths may be selected by requiring those wavelengths to provide a reduced subset of the data that facilitates fast computation but preserves the information content of the original spectrum. In a preferred embodiment, the wavelengths may be selected by subdividing the spectrum into N small regions whose endpoints have evenly spaced values of reciprocal wavelength, and then average the wavelength and the reflectivity within each region to obtain a single (wavelength, reflectivity) pair for each region. The number of regions should be chosen large enough so that the smallest features of interest in the reflectivity spectrum span four or more regions. The spectral data for fitting can then be thought of as a list R of length N without explicit reference to wavelength. An example of the calculated theoretical reflectance spectra is illustrated in spectra 2520 of FIG. 25B.

The method 2000 then scales and mean centers the calculated theoretical reflectance spectra data $R_{calc}$ in a step 2050. (See FIG. 25C trend 2530). In one embodiment, the method 2000 mean centers $R_{calc}$ and scales $R_{calc}$ by dividing it by its standard deviation (StDev). For example:

$$R_{calc} = \frac{(R_{calc} - \text{Mean}(R_{calc}))}{STDEV(R_{calc})}$$

Alternatively, the method 2000 scales and centers by:

$$R_{calc} = \frac{(R_{calc} - \text{Min}(R_{calc}))}{(\text{Max}(R_{calc}) - \text{Min}(R_{calc}))}$$

The method 2000 scales and centers the calculated data based on the observation that vertical range of the observed real-time data provides a convenient scale, and the scale can be imposed on the calculated model rather than trying to accurately calculate it. Trend 2530 of FIG. 25C illustrates an exemplary scaled and centered calculated theoretical reflectance spectra. By transforming both the observed real-time data and the calculated model in such a way that their vertical extent and spectrally averaged values coincide, the present invention can advantageously tolerate large errors in both the observed data and the calculated model and still find a deep minimum in the appropriately constructed merit function at the correct values of the wafer state parameters. See FIG. 24 for a discussion on a method of performing a model analysis on the observed data and the merit function. The method 2000 and the method disclosed in FIG. 24 are typically most successful if interference minima and maxima occur in every spectrum, which will be more likely if the data includes a wide range of wavelengths.

Next, the method 2000 stores the calculated model spectra in a step 2060. The calculated model spectra will be used by the method disclosed in FIG. 24. The method 2000 then stops processing in a step 2070. Of course, however, other embodiments of the present invention may have additional or fewer steps than described above.

Figure 24:
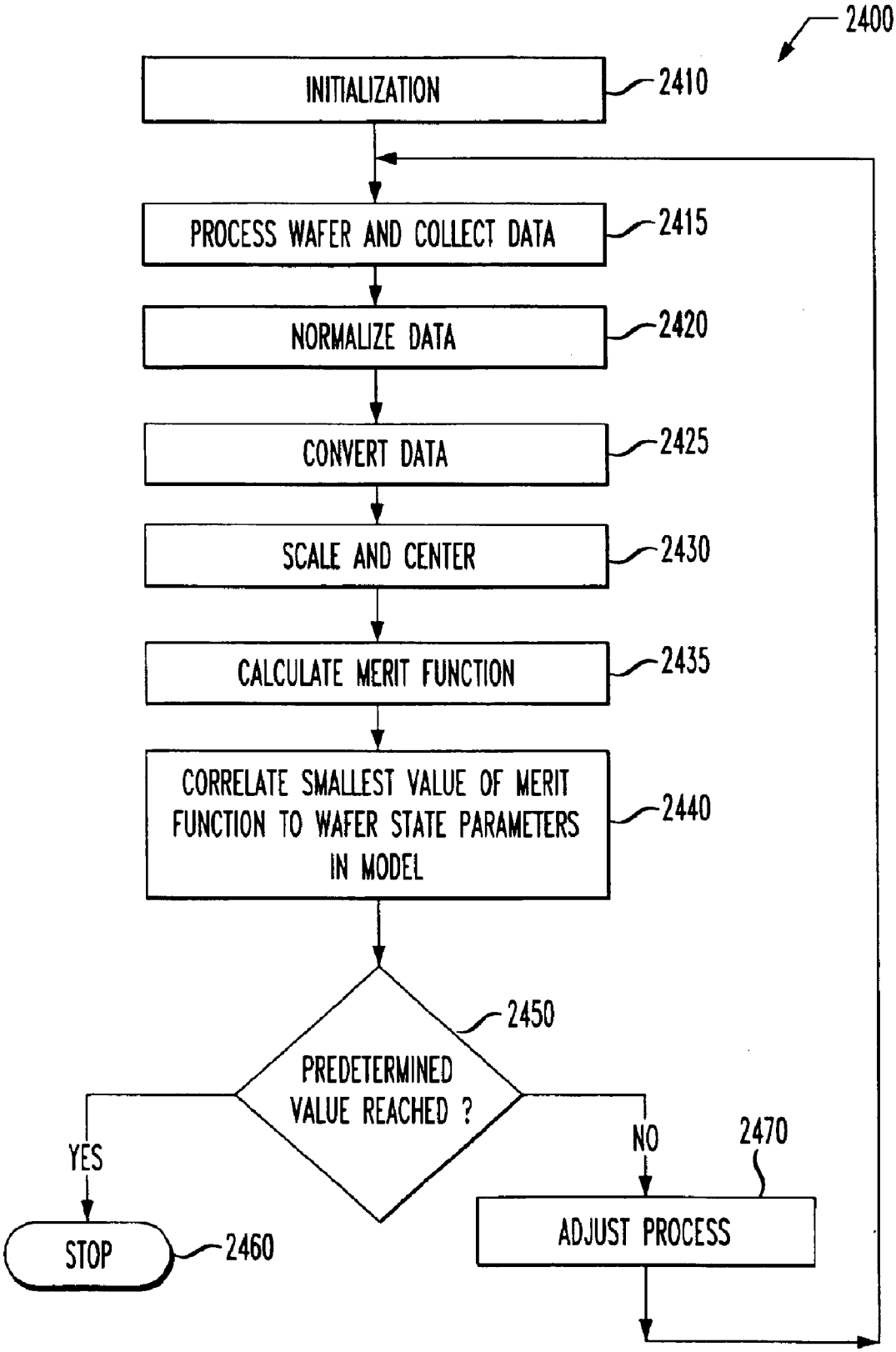
FIG. 24 illustrates a flow diagram of an embodiment of a method of performing a model analysis on real-time spectral reflectometry data conducted according to the principles of the present invention.

FIG. 24 illustrates a flow diagram of an embodiment of a method of performing a model analysis on real-time spectral reflectometry data, generally designated 2400, conducted according to the principles of the present invention. As discussed previously, the method 2400 will be described employing the simpler type of wafer called the silicon-on-insulator (SOI) wafer. (See FIG. 22). One skilled in the art should know that the SOI type wafer is for discussion purposes only and the present invention is not limited to only performing model analysis on SOI type wafers. In other embodiments, the present invention may perform model analysis on other types of wafers.

The method 2400 first performs initialization in a step 2410. After initialization, the method 2400 processes the wafer and collects reflectometry data in a step 2415. For the example SOI type wafer, the method 2400 may collect reflectance spectra from a 4 mm diameter spot on the SOI wafer. (See FIG. 23). Each raw spectrum, as collected, spanned a range of wavelengths λ of 225 nm to 800 nm at a resolution of 0.5 nm. See FIG. 25A trend 2510 for an exemplary raw spectrum for the SOI type wafer. One skilled in the art should know that each time a sample is obtained of the raw spectra, the location of the spot on the SOI wafer is typically at a different location. This is done in order to sample across the wafer during the CMP process. Also, in order to simplify the discussion, the method 2400 is described in respect to analyzing reflectance spectra from only one spot (collected by an optical probe). This is for discussion purposes only and is not a limitation. In other embodiments of the present invention, the method 2400 may analyze information obtained from a plurality of optical probes in performing model analysis.

Figure 25A:
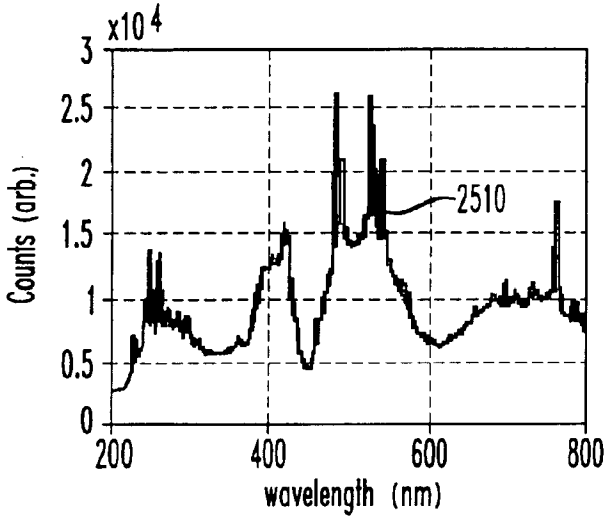
FIGS. 25A–D illustrate an example of the raw spectra and derived real-time spectral reflectometry data analyzed at various stages of the model analysis of FIG. 24.
Figure 25B:
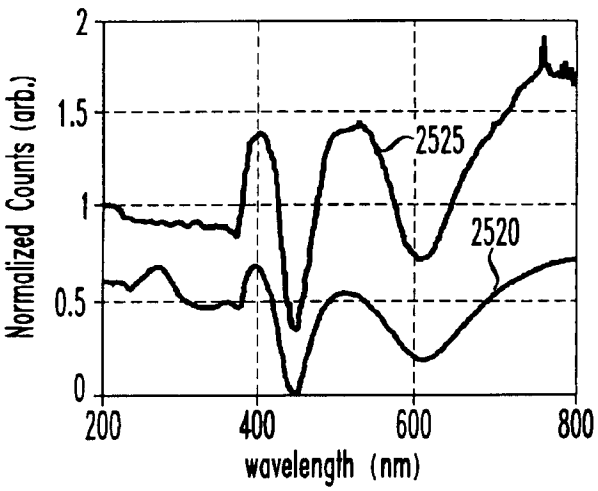
Figure 25C:
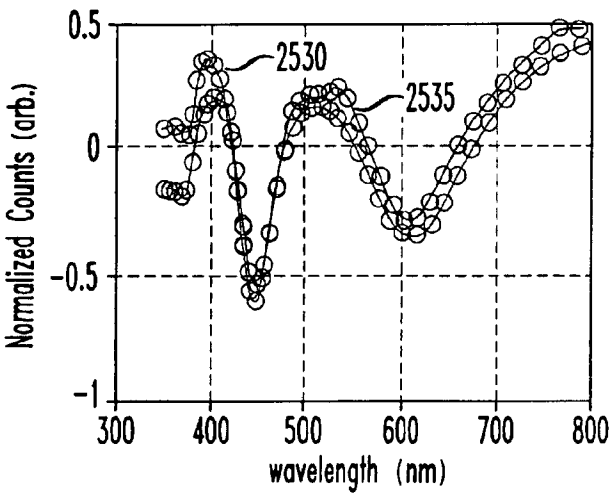

Next, the method 2400 normalizes the collected data with previously collected normalization data (Norm(λ)) in a step 2420. The normalization data Norm(λ), in one embodiment, is the data obtained from the normalization method of FIG. 7. The collected data may be normalized as follows:

$$R_{norm}(\lambda) = \frac{R(\lambda) * R_{Silicon}(\lambda)}{\text{Norm}(\lambda)}$$

where R(λ) is an alternative mathematical name for the raw spectral data of the currently processing water, and $R_{silicon}$ (λ) is the theoretical reflectance of a bare silicon wafer. This mathematical expression assumes that the normalization wafer was a bare silicon wafer. If the normalization data was collected from a different type of wafer, $R_{silicon}$ may be replaced with the theoretical expression for the wafer type used. Trend 2525 of FIG. 25B is an example of the normalized data.

The method 2400 may then convert the normalized data $R_{norm}$ to region data $R_{region}$ in a step 2425. In one embodiment, the method 2400 reduces the data to a minimal set of data that would facilitate fast computation and still substantially preserve the information content of the original spectrum. More specifically, the method 2400 may partition the normalized spectrum into a smaller number of regions and compute a single data point for each region. For example, if the normalized spectrum contained 1201 data points of 0.5 nm wavelength increments, the method 2400 may partition the normalized spectrum into 41 regions and compute a single data point for each region. In this example, 41 regions were chosen in order to facilitate fast computation. Of course, however, the present invention is not limited to 1201 data points nor 41 regions. Other embodiments of the present invention may have any number of data points and any number of regions satisfying the conditions set forth. Also, if computational speed is not an issue or a system can perform the computations within the bounds of in-situ requirements, than all of the data points may be used.

Given the selection of 41 regions, the method 2400 may then partition the data by computing a set of 42 wavelengths to serve as endpoints of the partitions (one more than the number of partitions desired in order to account for the beginning and ending points). It is preferable if the endpoints are chosen such that their wavelength reciprocals are approximately evenly distributed. Then from each partition, the method 2400 computes a single data point by averaging the nominal reflectivity over the entire region. After this transformation (conversion), at each time step t there is data in the form of a vector $R_{i,t}$, where i is the index corresponding to wavelength, and runs from 1 to the number of partitions N (41 in this case). One skilled in the art should known that it is assumed that the calculated model generated by the method of FIG. 20 has been partitioned to the same number and type of regions.

Next, the method 2400 scales and mean centers the region data $R_{region}$ in a step 2430. In one embodiment, the method 2400 mean centers $R_{region}$ and scales $R_{region}$ by dividing it by its standard deviation (StDev). For example:

$$R_{region} = \frac{(R_{region} - \text{Mean}(R_{region}))}{STDEV(R_{region})}$$

Alternatively, the method 2400 scales and centers by:

$$R_{region} = \frac{(R_{region} - \text{Min}(R_{region}))}{(\text{Max}(R_{region}) - \text{Min}(R_{region}))}$$

This reduces the amplitude variation of the signal. The vertical range of the data is also used to rescale the vertical range of the calculated model data. This relaxes the requirement of accurately calculating the reflectivity. The method 2400 is typically most successful if interference minima and maxima occur in every spectrum, which will be more likely if the data includes a wide range of wavelengths. In FIG. 25C, trend 2535 illustrates the scaled and mean centered normalized real-time data $R_{region}$ and trend 2530 illustrates the scaled and mean centered calculated model data $R_{calc}$. Note that each circle on the trends 2530, 2535 represent the average of the nominal reflectivity over that region. FIG. 25C also illustrates that more sampling may be performed over wavelengths where it is known that changes in the data may be more important or occur more rapidly, and less sampling may be performed over wavelengths where changes do not occur as fast or follows a known estimation.

The method 2400 then calculates a merit function of the data $R_{region}$ in a step 2435. In one embodiment, the method 2400 employs the merit function $M(p_1, p_2, \ldots, p_n)$ for comparison between the observed data R ($R_{region}$) and the model data $R^c$ ($R_{calc}$), such that:

$$M(p_1, p_2, \ldots, p_n) = \sum_{j=1}^{N} (T[R_j^c(p_1, p_2)] - T[R_j])^2$$

with $$T(R_i) = \frac{R_i - \frac{1}{N}\sum_{j=1}^{N} R_j}{\text{Max}(R_i) - \text{Min}(R_i)}$$

where $T(R_i)$ is the data vector representing the converted, scaled and centered data. Thus, the merit function produces a table having $p_n$ dimensions that can be searched. That is, one dimension for every wafer state parameter employed in the method.

Next, the method 2400 correlates a smallest value of the merit function to the wafer state parameters in the calculated model in a step 2440. In one embodiment, the method 2400 may correlate by performing a minimization of the merit function by standard techniques, such as the Levenburg-Marquardt method. Also since the number of parameters being searched may be smaller due to partitioning by regions, an exhaustive search of the entire parameter space on a discrete grid may be done instead of by numerical minimization techniques. One skilled in the art is familiar with merit functions, minimization of merit functions, Levenburg-Marquardt method and exhaustive search methods.

In an alternative embodiment, the model and above described steps may be computed in advance to create a lookup table that can be searched exhaustively at run time. For example, given the SOI wafer and two wafer state parameters (thickness of the SOI layer $d_1$ and thickness of the BOX layer $d_2$) the merit function would be:

$$M_t(d_1, d_2) = \sum_{j=1}^{N} (T[R_{j,t}^c(d_1, d_2)] - T[R_{j,t}])^2$$

The lookup table would contain a set of vectors $T[R_{j,t}^c(d_1, d_2)]$ for every possible SOI layer and BOX layer thickness pair on 1 nm intervals over the full range of expected values. This may be preferable to numerical minimization techniques because the results do not depend on an initial guess.

Figure 25D:
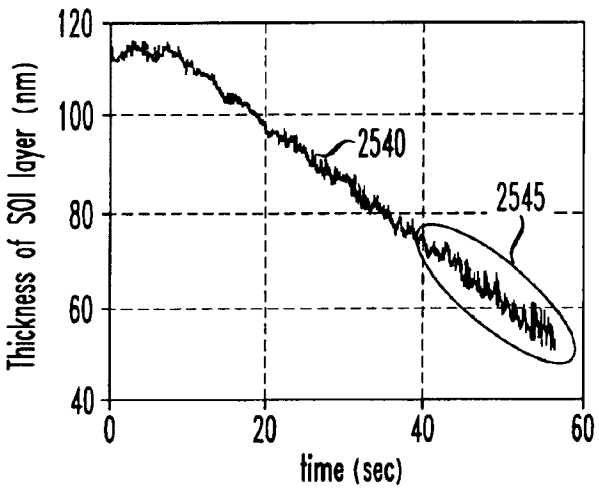

At completion of the step 2440, the method 2400 has the values for each of the wafer state parameters in the model in relation to the observed data at a specific point in time. Trend 2540 of FIG. 25D illustrates the results of the merit function and correlation for the wafer state parameter $d_1$ (SOI layer thickness). The wafer state parameter $d_2$ (BOX layer thickness) is not shown because it has not changed by the polishing process since the SOI layer fully covers the BOX layer. (See FIG. 22).

The method 2400 then determines if the wafer state parameter value(s) derived in the step 2440 has reached a predetermined value of the wafer state parameter(s) in a decisional step 2450. If the predetermined value of the wafer state parameter(s) has been reached, the process stops in a step 2460. For example, if the predetermined stopping thickness (endpoint) of the SOI layer was required to be 70 nm, the polishing process would have been automatically stopped about 40 seconds. See trend 2540 of FIG. 25D. Further observation indicates that the trend 2540 begins to present more variation in thickness of the SOI layer as the polishing advances in time. (See trend section 2545). Ideally, the trend 2540 should be a straight line at fixed slope. This would denote a fixed removal rate and no emerging non-uniformity. This type of variation occurring after 40 seconds denotes emerging non-uniformity in the thickness of the film due to the polishing process. Information about this emerging non-uniformity may be employed to control the polishing process and limit the deleterious effects of the non-uniformity on the quality of the wafer.

If the predetermined value of the wafer state parameter(s) has not been reached in the decisional step 2450, the method 2400 may adjust the polishing process in a step 2470. For example, if the trend 2540 of FIG. 25D has variations, such as illustrated in section 2545, occurring earlier in time, the method 2400 may cause the polishing process to correct for this imperfection. The method 2400 then returns to process and collect more data in the step 2415. Of course, however, other embodiments of the present invention may have additional or fewer steps than described above.

Figure 26:
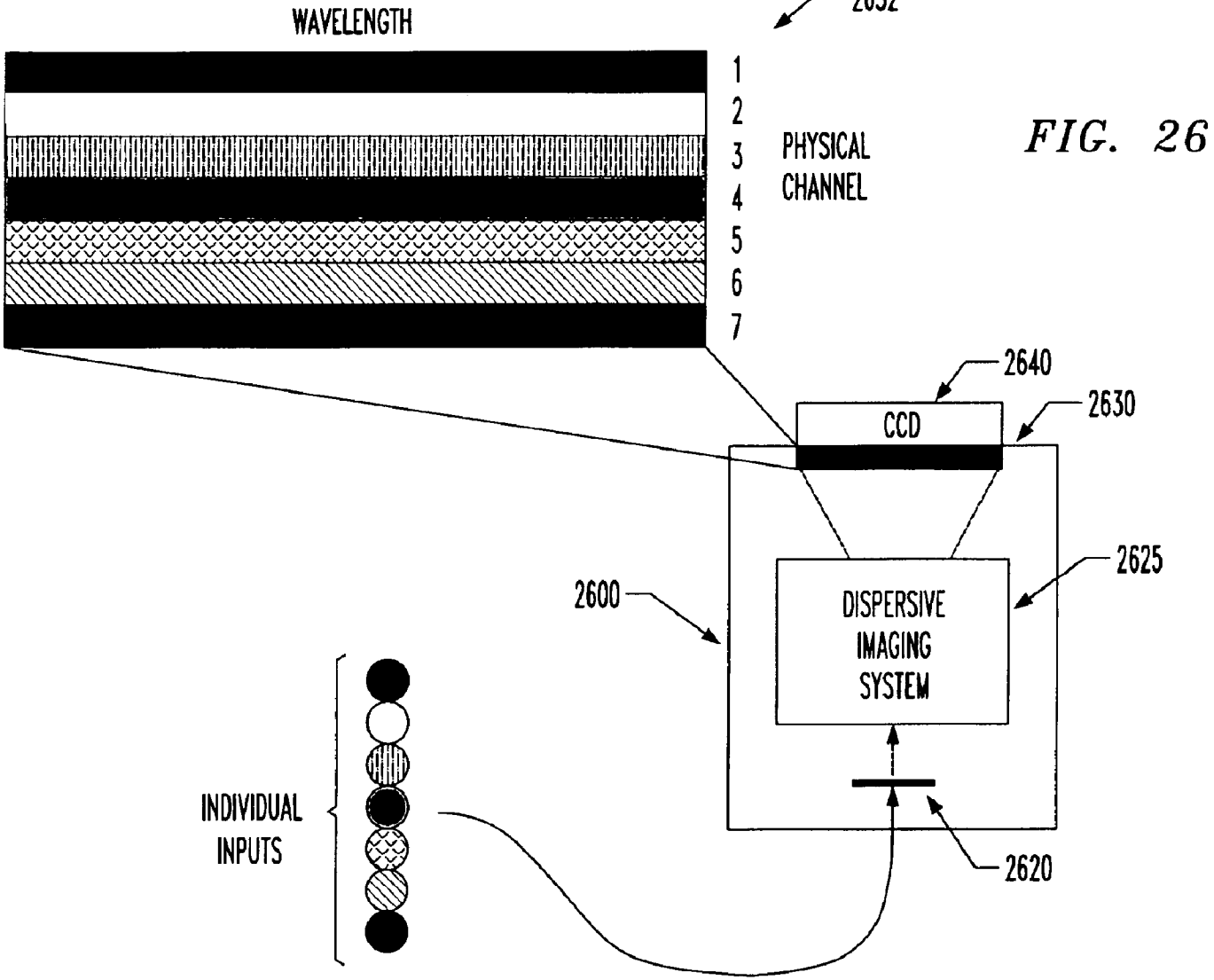
FIG. 26 illustrates a spectrograph for spatially imaging light received by optical probes to a common charge-coupled device constructed according to the principles of the present invention.

Turning now to FIG. 26, illustrated is an embodiment of a spectrograph, generally designated 2600, for spatially imaging light received by optical probes to a common charge-coupled device (CCD) constructed according to the principles of the present invention. The spectrograph 2600 includes an entrance slit, 2620, a dispersive imaging system 2625, an image plane 2630 and a CCD 2640. The spectrograph 2600 receives individual light inputs (or channels) at a specific point on an entrance slit 2620. The dispersive imaging system 2625 images the light that impinges upon the multiple sources at the entrance slit 2620 on to the image plane 2630 of the CCD 2640. The image is separated physically by the independent incident channel in one dimension and, in a second dimension, is distributed over wavelength. See blow-up 2632 of the image plane 2630 for an example of how the individual inputs are spatially imaged. The CCD 2640 then captures and converts the spatially imaged light to digital information. An example of a commercial imaging spectrograph is the SD1024, available from Verity Instruments, Inc., of Carrollton, Tex.

While the methods disclosed herein have been described and shown with reference to particular steps performed in a particular order, it will be understood that these steps may be combined, subdivided, or reordered to form an equivalent method without departing from the teachings of the present invention. Accordingly, unless specifically indicated herein, the order and/or the grouping of the steps are not limitations of the present invention.

Although the present invention has been described in detail, those skilled in the art should understood that they can make various changes, substitutions and alterations herein without departing from the spirit and scope of the invention in its broadest form.

What is claimed is:

1. An optical closed-loop control system for use with a chemical mechanical polishing (CMP) apparatus for polishing a semiconductor wafer, said CMP apparatus having a platen, a polishing pad coupleable with a top surface of said platen and a wafer carrier, said system comprising:

a plurality of optical probes impacting a corresponding probe window and rigidly mountable through said platen, said probe window positioned within said polishing pad;

a flash lamp configured to provide light to each of said plurality of said optical probes and minimize an exposure time of said light onto said semiconductor wafer;

a spectrograph configured to spatially image light received by each of said plurality of said optical probes to a common charge-coupled device (CCD) and produce real-time spectral reflectometry data therefrom; and a control subsystem configured to analyze said real-time spectral reflectometry data and determine at least one wafer state parameter therefrom, and cause polishing to be adjusted based upon said at least one wafer state parameter.

2. The optical closed-loop control system as recited in claim 1 wherein each of said plurality of said optical probes further include an integral gradient index lens.

3. The optical closed-loop control system as recited in claim 1 wherein each of said plurality of said optical probes includes an element selected from the group consisting of:

a plurality of illumination fibers that provide collimated illumination, a collimated illumination optics, and a collimated collection optics.

4. The optical closed-loop control system as recited in claim 1 wherein said flash lamp in combination with each of said plurality of said optical probes provide sampling spot isolation, thereby preserving an interference contrast of said light reflected.

5. The optical closed-loop control system as recited in claim 1 wherein each of said plurality of said optical probes are positioned a distance from said top surface of said platen, wherein said distance is chosen such that each of said plurality of optical probes is impacted into each of said windows by an amount greater than 0.0 but less than 0.2 inches.

6. The optical closed-loop control system as recited in claim 1 wherein said plurality of said optical probes are positioned along said top surface of said platen to allow monitoring of said semiconductor wafer at specific radial locations.

7. The optical closed-loop control system as recited in claim 1 wherein said wafer carrier includes a plurality of controllable pressure zones, said control subsystem further configured to employ said at least one wafer state parameter to individually control each of said plurality of said controllable pressure zones to adjust pressure applied to different portions of said semiconductor wafer in order to optimize polishing of said semiconductor wafer.

8. The optical closed-loop control system as recited in claim 1 wherein said control subsystem is further configured to control a movement of said wafer carrier based upon said at least one wafer state parameter.

9. The optical closed-loop control system as recited in claim 1 wherein said platen is a moving platen, said control subsystem further configured to control a movement of said moving platen based upon said at least one wafer state parameter.

10. The optical closed-up control system as recited in claim 1 wherein said platen is a moving platen, said flash lamp, said spectrograph and at least a portion of said control subsystem are coupled to said moving platen.

11. The optical closed-loop control system as recited in claim 10 wherein said control subsystem is further configured to control a movement of said wafer carrier and a movement of said moving platen based upon said at least one wafer state parameter.

12. The optical closed-loop control system as recited in claim 10 wherein said control system is further configured to employ a wireless interface module to transmit closed-loop control information to said CMP apparatus to control at least said wafer carrier.

13. The optical closed-loop control system as recited in claim 1 wherein said control subsystem is further configured to perform a normalization using a reference wafer and employ data obtained therefrom in at least said determination of said at least one wafer state parameter.

14. The optical closed-loop control system as recited in claim 1 wherein said control subsystem is further configured to adjust for attenuation of said light received due to a slurry or said probe window during polishing of said wafer.

15. The optical closed-loop control system as recited in claim 1 wherein said control subsystem is further configured to employ an analysis model selected from the group consisting of:

a n-band analysis, a transform analysis, a metal breakthrough analysis, and a model analysis.

16. A method of manufacturing an optical closed-loop control system for use with a chemical mechanical polishing (CMP) apparatus for polishing a semiconductor wafer, said CMP apparatus having a platen, a polishing pad coupleable with a top surface of said platen and a wafer carrier, said method comprising:

rigidly mounting through said platen a plurality of optical probes impacting a corresponding probe window, said probe window positioned within said polishing pad;

coupling a flash lamp to each of said plurality of said optical probes to provide light thereto and configuring said flash lamp to minimize an exposure time of said light onto said semiconductor wafer;

configuring a spectrograph to spatially image light received by each of said plurality of said optical probes to a common charge-coupled device (CCD) and producing real-time spectral reflectometry data therefrom; and configuring a control subsystem to analyze said real-time spectral reflectometry data and determine at least one wafer state parameter therefrom, and cause said polishing to be adjusted based upon said at least one wafer state parameter.

17. The method as recited in claim 16 wherein each of said plurality of said optical probes further include an integral gradient index lens.

18. The method as recited in claim 16 wherein each of said plurality of said optical probes includes an element selected from the group consisting of:

a plurality of illumination fibers that provide collimated illumination, a collimated illumination optics, and a collimated collection optics.

19. The method as recited in claim 16 further comprising employing said flash lamp in combination with each of said plurality of said optical probes provide sampling spot isolation, thereby preserving an interference contrast of said light reflected.

20. The method as recited in claim 16 wherein said rigidly mounting further includes positioning each of said plurality of said optical probes a distance from said top surface of said platen, wherein said distance is chosen such that each of said plurality of optical probes is impacted into each of said windows by an amount greater than 0.0 but less than 0.2 inches.

21. The method as recited in claim 16 further comprising positioning said plurality of said optical probes along said top surface of said platen to allow monitoring of said semiconductor wafer at specific radial locations.

22. The method as recited in claim 16 wherein said wafer carrier includes a plurality of controllable pressure zones, said configuring said control subsystem further includes configuring said control subsystem to employ said at least one wafer state parameter to individually control each of said plurality of said controllable pressure zones to adjust pressure applied to different portions of said semiconductor wafer in order to optimize polishing of said semiconductor wafer.

23. The method as recited in claim 16 wherein said configuring said control subsystem further includes configuring said control subsystem to control a movement of said wafer carrier based upon said at least one wafer state parameter.

24. The method as recited in claim 16 wherein said platen is a moving platen, configuring said control subsystem further includes configuring said control subsystem to control a movement of said moving platen based upon said at least one wafer state parameter.

25. The method as recited in claim 16 wherein said platen is a moving platen, said method further comprising coupling said flash lamp, said spectrograph and at least a portion of said control subsystem to said moving platen.

26. The method as recited in claim 25 wherein said configuring said control subsystem further includes configuring said control subsystem to control a movement of said wafer carrier and a movement of said moving platen based upon said at least one wafer state parameter.

27. The method as recited in claim 25 wherein said configuring said control subsystem further includes configuring said control subsystem to employ a wireless interface module to transmit closed-loop control information to said CMP apparatus to control at least said wafer carrier.

28. The method as recited in claim 16 wherein said configuring said control subsystem further includes configuring said control subsystem to perform a normalization using a reference wafer and employ data obtained therefrom in at least said determination of said at least one wafer state parameter.

29. The method as recited in claim 16 wherein said configuring said control subsystem further includes configuring said control subsystem to adjust for attenuation of said light received due to a slurry of said probe window during polishing of said wafer.

30. The method as recited in claim 16 wherein said configuring said control subsystem further includes configuring said control subsystem to employ an analysis model selected from the group consisting of:

a n-band analysis, a transform analysis, a metal breakthrough analysis, and a model analysis.

31. A method of operating an optical closed-loop control system for use with a chemical mechanical polishing (CMP) apparatus for polishing a semiconductor wafer, said CMP apparatus having a platen, a polishing pad coupleable with a top surface of said platen and a wafer carrier, said method comprising:

employing a plurality of optical probes impacting a corresponding probe window and rigidly mountable through said platen, said probe window positioned within said polishing pad;

providing light to each of said plurality of said optical probes employing a flash lamp and minimizing an exposure time of said light onto said semiconductor wafer;

spatially imaging light received by each of said plurality of said optical probes to a common charge-coupled device (CCD) of a spectrograph and producing real-time spectral reflectometry data therefrom; and analyzing said real-time spectral reflectometry data, determining at least one wafer state parameter from said real-time spectral reflectometry data, and causing said polishing to be adjusted based upon said at least one wafer state parameter.

32. The method as recited in claim 31 wherein said wafer carrier includes a plurality of controllable pressure zones, said method further comprising employing said at least one wafer state parameter to individually control each of said plurality of said controllable pressure zones to adjust pressure applied to different portions of said semiconductor wafer in order to optimize polishing of said semiconductor wafer.

33. The method as recited in claim 31 further comprising controlling a movement of said wafer carrier based upon said at least one wafer state parameter.

34. The method as recited in claim 31 wherein said platen is a moving platen, said method further comprising controlling a movement of said moving platen based upon said at least one wafer state parameter.

35. The method as recited in claim 31 wherein said platen is a moving platen, said method further comprising controlling a movement of said wafer carrier and a movement said moving platen based upon said at least one wafer state parameter.

36. The method as recited in claim 31 further comprising performing a normalization using a reference wafer and employing data obtained therefrom in at least said determination of said at least one wafer state parameter.

37. The method as recited in claim 21 wherein said analyzing further includes adjusting for attenuated of said light received due to a slurry or said probe window during polishing of said wafer.

38. The method as recited in claim 31 wherein said analyzing further includes employing an analysis model selected from the group consisting of:

a n-band analysis, a transform analysis, a metal breakthrough analysis, and a model analysis.

39. An optical closed-loop control system for use with a chemical mechanical polishing (CMP) apparatus for polishing a semiconductor wafer, said CMP apparatus having a platen, a polishing pad coupleable with a top surface of said platen, a plurality of probe windows within said polishing pad and a wafer carrier, said system comprising:

a plurality of optical probes coupleable to corresponding ones of said plurality of probe windows and mountable through said platen;

a flash lamp configured to provide light to each of said plurality of said optical probes;

a spectrograph configured to spatially image light received by each of said plurality of said optical probes and produce real-time spectral reflectometry data therefrom; and a control subsystem configured to employ a n-band analysis to analyze said real-time spectral reflectometry data and determine at least one wafer state parameter therefrom, and cause said polishing to be adjusted based upon said at least one wafer state parameter.

40. An optical closed-loop control system for use with a chemical mechanical polishing (CMP) apparatus for polishing a semiconductor wafer, said CMP apparatus having a platen, a polishing pad coupleable with a top surface of said platen, a plurality of probe windows within said polishing pad and a wafer carrier, said system comprising:

a plurality of optical probes coupleable to corresponding ones of said plurality of probe windows and mountable through said platen;

a flash lamp configured to provide light to each of said plurality of said optical probes;

a spectrograph configured to spatially image light received by each of said plurality of said optical probes and produce real-time spectral reflectometry data therefrom; and a control subsystem configured to employ a transform analysis to analyze said real-time spectral reflectometry data and determine at least one wafer state parameter therefrom, and cause said polishing to be adjusted based upon said at least one wafer state parameter.

41. An optical closed-loop control system for use with a chemical mechanical polishing (CMP) apparatus for polishing a semiconductor wafer, said CMP apparatus having a platen, a polishing pad coupleable with a top surface of said platen, a plurality of probe windows within said polishing pad and wafer carrier, said system comprising:

a plurality of optical probes coupleable to corresponding ones of said plurality of probe windows and mountable through said platen;

a flash lamp configured to provide light to each of said plurality of said optical probes;

a spectrograph configured to spatially image light received by each of said plurality of said optical probes and produce real-time spectral reflectometry data therefrom; and a control subsystem configured to employ a metal breakthrough analysis to analyze said real-time spectral reflectometry data and determine at least one wafer state parameter therefrom, and cause said polishing to be adjusted based upon said at least one wafer state parameter.

42. An optical closed control system for use with a chemical mechanical polishing (CMP) apparatus for polishing a semiconductor wafer, said CMP apparatus having a platen, a polishing pad coupleable with a top surface of said platen, a plurality of probe windows within said polishing pad and a wafer carrier, said system comprising:

a plurality of optical probes coupleable to corresponding ones of said plurality of probe windows and mountable through said platen;

a flash lamp configured to provide light to each of said plurality of said optical probes;

a spectrograph configured to spatially image light received by each of said plurality of said optical probes and produce real-time spectral reflectometry data therefrom; and a control subsystem configured to employ a model analysis to analyze said real-time spectral reflectometry data and determine at least one wafer state parameter therefrom, and cause said polishing to be adjusted based upon said at least one wafer state parameter.

* * * * *